US010388442B2

(12) United States Patent
Ishii et al.

(10) Patent No.: US 10,388,442 B2
(45) **Date of Patent: *Aug. 20, 2019**

(54) R-T-B BASED SINTERED MAGNET AND METHOD FOR PRODUCING R-T-B BASED SINTERED MAGNET

(71) Applicant: HITACHI METALS, LTD., Tokyo (JP)

(72) Inventors: Rintaro Ishii, Mishima-gun (JP); Futoshi Kuniyoshi, Mishima-gun (JP); Teppei Satoh, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 538 days.

This patent is subject to a terminal disclaimer.

(21) Appl. No.: 14/911,517

(22) PCT Filed: Aug. 11, 2014

(86) PCT No.: PCT/JP2014/071229

§ 371 (c)(1),
(2) Date: Feb. 11, 2016

(87) PCT Pub. No.: WO2015/022946

PCT Pub. Date: Feb. 19, 2015

(65) Prior Publication Data

US 2016/0189837 A1 Jun. 30, 2016

(30) Foreign Application Priority Data

Aug. 12, 2013 (JP) ..... 2013-167333
Nov. 26, 2013 (JP) ..... 2013-243497
Feb. 28, 2014 (JP) ..... 2014-037836

(51) Int. Cl.
*H01F 1/057* (2006.01)
*B22F 1/00* (2006.01)
(Continued)

(52) U.S. Cl.
CPC ..... *H01F 1/0577* (2013.01); *B22F 1/0003* (2013.01); *B22F 3/16* (2013.01);
(Continued)

(58) Field of Classification Search
CPC ..... H01F 1/0577; B22F 2301/355; C22C 2202/02
See application file for complete search history.

(56) References Cited

U.S. PATENT DOCUMENTS

2010/0233016 A1* 9/2010 Tsubokura ..... C22C 33/0278 420/83
2011/0095855 A1* 4/2011 Kuniyoshi ..... H01F 1/0577 335/302
(Continued)

FOREIGN PATENT DOCUMENTS

EP 2980808 A1 2/2016
EP 2985768 A1 2/2016
(Continued)

OTHER PUBLICATIONS

International Search Report of PCT/JP2014/071229, dated Nov. 11, 2014. [PCT/ISA/210].
(Continued)

*Primary Examiner* — Colleen P Dunn
*Assistant Examiner* — Jeremy C Jones
(74) *Attorney, Agent, or Firm* — Sughrue Mion, PLLC

(57) ABSTRACT

To provide an R-T-B based sintered magnet having high $B_r$ and high $H_{cJ}$ while suppressing the content of Dy, and a method for producing the same. Disclosed is an R-T-B based sintered magnet represented by the formula: uRwBxGayCuzAlqMT, where $0.20 \le x \le 0.70$, $0.07 \le y \le 0.2$, $0.05 \le z \le 0.5$, $0 \le q \le 0.1$; $v = u - (6\alpha + 10\beta + 8\gamma)$, where the amount of oxygen (% by mass) is $\alpha$, the amount of nitrogen (% by mass) is $\beta$, and the amount of carbon (% by mass) is $\gamma$; when
(Continued)

0.40≤x≤0.70, v and w satisfy the following inequality expressions: 50w−18.5≤v≤50w−14, and −12.5w+38.75≤v≤−62.5w+86.125; and, when 0.20≤x≤0.40, v and w satisfy the following inequality expressions: 50w−18.5≤v≤50w−15.5 and −12.5w+39.125≤v≤−62.5w+86.125, and x satisfy the following inequality expression: −(62.5w+v−81.625)/15+0.5≤x≤−(62.5w+v−81.625)/15+0.8.

9 Claims, 6 Drawing Sheets

(51) Int. Cl.

| | |
|---|---|
| ***B22F 3/16*** | (2006.01) |
| ***B22F 9/04*** | (2006.01) |
| ***C22C 33/02*** | (2006.01) |
| ***C22C 38/00*** | (2006.01) |
| ***B22F 3/24*** | (2006.01) |
| ***C22C 30/02*** | (2006.01) |
| ***C22C 38/06*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |

(52) U.S. Cl.

CPC ..... *B22F 3/24* (2013.01); *B22F 9/04* (2013.01); *C22C 30/02* (2013.01); *C22C 33/02* (2013.01); *C22C 38/00* (2013.01); *C22C 38/001* (2013.01); *C22C 38/002* (2013.01); *C22C 38/005* (2013.01); *C22C 38/06* (2013.01); *C22C 38/10* (2013.01); *C22C 38/12* (2013.01); *C22C 38/14* (2013.01); *C22C 38/16* (2013.01); *B22F 2003/248* (2013.01); *B22F 2301/355* (2013.01); *B22F 2998/10* (2013.01); *C22C 2202/02* (2013.01)

(56) References Cited

U.S. PATENT DOCUMENTS

| | | | | |
|---|---|---|---|---|
| 2011/0262297 | A1* | 10/2011 | Ishii | B22F 1/0014 419/23 |
| 2014/0132377 | A1 | 5/2014 | Nakajima et al. | |
| 2014/0286815 | A1 | 9/2014 | Ishiyama et al. | |
| 2016/0042847 | A1* | 2/2016 | Nishiuchi | C22C 38/001 335/302 |

FOREIGN PATENT DOCUMENTS

| | | | |
|---|---|---|---|
| JP | 10-289813 | A | 10/1998 |
| JP | 2009-260338 | A | 11/2009 |
| JP | 2011211056 | A | 10/2011 |
| WO | 2009/004994 | A1 | 1/2009 |
| WO | 2013/008756 | A1 | 1/2013 |
| WO | 2013/054845 | A1 | 4/2013 |

OTHER PUBLICATIONS

Communication dated Mar. 23, 2017, issued by the European Patent Office in corresponding European Application No. 14836886.3.

International Preliminary Report on Patentability dated Feb. 16, 2016 from the International Bureau of WIPO in application No. PCT/JP2014/071229.

* cited by examiner

R-T-B BASED SINTERED MAGNET AND METHOD FOR PRODUCING R-T-B BASED SINTERED MAGNET

CROSS REFERENCE TO RELATED APPLICATIONS

This application is a National Stage of International Application No. PCT/JP2014/071229 filed Aug. 11, 2014 (claiming priority based on Japanese Patent Application Nos. 2013-167333, filed Aug. 12, 2013, 2013-243497, filed Nov. 26, 2013, and 2014-037836, filed Feb. 28, 2014), the contents of which are incorporated herein by reference in their entirety.

TECHNICAL FIELD

The present disclosure relates to an R-T-B based sintered magnet, and a method for producing an R-T-B based sintered magnet.

BACKGROUND ART

An R-T-B-based sintered magnet including an $R_2T_{14}B$ type compound as a main phase (R is composed of light rare-earth element(s) RL and heavy rare-earth element(s) RH, RL is Nd and/or Pr, RH is at least one of Dy, Tb, Gd and Ho, and T is at least one of transition metal elements and inevitably includes Fe) has been known as a permanent magnet with the highest performance among permanent magnets, and has been used in various motors for hybrid cars, electric cars and home appliances.

However, in the R-T-B-based sintered magnet, coercive force $H_{cJ}$ (hereinafter sometimes simply referred to as "$H_{cJ}$") decreases at a high temperature to cause irreversible thermal demagnetization. Therefore, when used particularly in motors for hybrid cars and electric cars, there is a need to maintain high $H_{cJ}$ even at a high temperature.

To increase $H_{cJ}$, a large amount of heavy rare-earth elements (mainly, Dy) have hitherto been added to the R-T-B-based sintered magnet. However, there arose a problem that a residual magnetic flux density $B_r$ (hereinafter sometimes simply referred to as "$B_r$") decreases. Therefore, there has recently been employed a method in which heavy rare-earth elements are diffused from the surface into the inside of the R-T-B-based sintered magnet to thereby increase the concentration of the heavy rare-earth elements at the outer shell part of main phase crystal grains, thus obtaining high $H_{cJ}$ while suppressing a decrease in $B_r$.

Dy has problems such as unstable supply and price fluctuations because of restriction of the producing district. Therefore, there is a need to develop technology for improving $H_{cJ}$ of the R-T-B-based sintered magnet without using heavy rare-earth elements such as Dy as much as possible (by reducing the amount as much as possible).

Patent Document 1 discloses that the amount of B is decreased as compared with a conventional R-T-B-based alloy and one or more metal elements M selected from among Al, Ga, and Cu are included to form a $R_2T_{17}$ phase, and a volume fraction of a transition metal-rich phase ($R_6T_{13}M$) formed from the $R_2T_{17}$ phase as a raw material is sufficiently secured to obtain an R-T-B-based rare-earth sintered magnet having high coercive force while suppressing the content of Dy.

PRIOR ART DOCUMENT

Patent Document

Patent Document 1: WO 2013/008756 A

SUMMARY OF THE INVENTION

Problems to be Solved by the Invention

However, the R-T-B-based rare-earth sintered magnet according to Patent Document 1 had a problem that the amount of R is increased and the amount of B is decreased more than before, so that an existence ratio of a main phase decreases, leading to significant reduction in Br.

The present disclosure has been made so as to solve the above problems and an object thereof is to provide an R-T-B based sintered magnet having high $B_r$ and high $H_{cH}$ while suppressing the content of Dy, and a method for producing the same.

Means for Solving the Problems

Aspect 1 of the present invention is directed to an R-T-B based sintered magnet represented by the following formula (1):

$$uRwBxGayCuzAlqM(100\text{-}u\text{-}w\text{-}x\text{-}y\text{-}z\text{-}q)T \quad (1)$$

where

R is composed of light rare-earth element(s) RL and heavy rare-earth element(s) RH, RL is Nd and/or Pr, RH is at least one of Dy, Tb, Gd and Ho, T is Fe, and 10% by mass or less of Fe is capable of being replaced with Co, M is Nb and/or Zr and u, w, x, y, z, q and 100-u-w-x-y-z-q are expressed in terms of % by mass;

said RH accounts for 5% by mass or less of the R-T-B based sintered magnet, the following inequality expressions (2) to (5) being satisfied:

$$0.20 \le x \le 0.70 \quad (2)$$

$$0.07 \le y \le 0.2 \quad (3)$$

$$0.05 \le z \le 0.5 \quad (4)$$

$$0 \le q \le 0.1 \quad (5)$$

$v=u-(6\alpha+10\beta, +8\gamma)$, where the amount of oxygen (% by mass) of the R-T-B based sintered magnet is $\alpha$, the amount of nitrogen (% by mass) is $\beta$, and the amount of carbon (% by mass) is $\gamma$;

when $0.40 \le x \le 0.70$, v and w satisfy the following inequality expressions (6) and (7):

$$50w-18.5 \le v \le 50w-14 \quad (6)$$

$$-12.5w+38.75 \le v \le -62.5w+86.125 \quad (7)$$

and, when $0.20 \le x < 0.40$, v and w satisfy the following inequality expressions (8) and (9), and x satisfies the following inequality expression (10):

$$50w-18.5 \le v \le 50w-15.5 \quad (8)$$

$$-12.5w+39.125 \le v \le -62.5w+86.125 \quad (9)$$

$$-(62.5w+v-81.625)/15+0.5 \le x \le -(62.5w+v-81.625)/15+0.8 \quad (10).$$

Aspect 2 of the present invention is directed to the R-T-B based sintered magnet according to the aspect 1, wherein, when $0.40 \le x \le 0.70$, v and w satisfy the following inequality expressions (11) and (7):

$$50w-18.5 \le v \le 50w-16.25 \quad (11)$$

$$-12.5w+38.75 \le v \le -62.5w+86.125 \quad (7)$$

and, when $0.20 \le x < 0.40$, v and w satisfy the following inequality expressions (12) and (9), and x satisfies the following inequality expression (10):

$$50w-18.5 \le v \le 50w-17.0 \quad (12)$$

$$-12.5w+39.125 \le v \le -62.5w+86.125 \quad (9)$$

$$-(62.5w+v-81.625)/15+0.5 \le x \le -(62.5w+v-81.625)/15+0.8 \quad (10).$$

In the aspect 1 and 2, the amount of oxygen of the R-T-B based sintered magnet is preferably 0.15% by mass or less.

Aspect 3 of the present invention is a preferred aspect of the method for producing an R-T-B based sintered magnet of the aspect 1, the R-T-B based sintered magnet being represented by the following formula (1):

$$uRwBxGayCuzAlqM(100-u-w-x-y-z-q)T \quad (1)$$

where

R is composed of light rare-earth element(s) RL and heavy rare-earth element(s) RH, RL is Nd and/or Pr, RH is at least one of Dy, Tb, Gd and Ho, T is Fe, and 10% by mass or less of Fe is capable of being replaced with Co, M is Nb and/or Zr, and u, w, x, y, z, q and 100-u-w-x-y-z-q are expressed in terms of % by mass;

said RH accounts for 5% by mass or less of the R-T-B based sintered magnet, the following inequality expressions (2) to (5) being satisfied:

$$0.20 \le x \le 0.70 \quad (2)$$

$$0.07 \le y \le 0.2 \quad (3)$$

$$0.05 \le z \le 0.5 \quad (4)$$

$$0 \le q \le 0.1 \quad (5)$$

$v=u-(6\alpha+10\beta+8\gamma)$, where the amount of oxygen (% by mass) of the R-T-B based sintered magnet is $\alpha$, the amount of nitrogen (% by mass) is $\beta$, and the amount of carbon (% by mass) is $\gamma$; and when $0.40 \le x \le 0.70$, v and w satisfy the following inequality expressions (6) and (7):

$$50w-18.5 \le v \le 50w-14 \quad (6)$$

$$-12.5w+38.75 \le v \le -62.5w+86.125 \quad (7)$$

and, when $0.20 \le x < 0.40$, v and w satisfy the following inequality expressions (8) and (9), and x satisfies the following inequality expression (10):

$$50w-18.5 \le v \le 50w-15.5 \quad (8)$$

$$-12.5w+39.125 \le v \le -62.5w+86.125 \quad (9)$$

$$-(62.5w+v-81.625)/15+0.5 \le x \le -(62.5w+v-81.625)/15+0.8 \quad (10)$$

the method including:

a step of preparing one or more kinds of additional alloy powders and one or more kinds of main alloy powders;

a step of mixing the one or more kinds of additional alloy powders with 0.5% by mass or more and 40% by mass or less among 100% by mass of the mixed alloy powder after mixing to obtain a mixed alloy powder of the one or more kinds of additional alloy powders and the one or more kinds of main alloy powders;

a compacting step of compacting the mixed alloy powder to obtain a compact;

a sintering step of sintering the compact to obtain a sintered body; and a heat treatment step of subjecting the sintered body to a heat treatment;

wherein the one or more kinds of additional alloy powders are respectively represented by the following inequality expression (13), each having the composition satisfying the following inequality expressions (14) to (20):

$$aRbBcGadCueAlfM(100-a-b-c-d-e-f)T \quad (13)$$

where

R is composed of light rare-earth element(s) RL and heavy rare-earth element(s) RH, RL is Nd and/or Pr, RH is at least one of Dy, Tb, Gd and Ho, T as balance is Fe, and 10% by mass or less of Fe is capable of being replaced with Co, M is Nb and/or Zr, and a, b, c, d, e, f, and 100-a-b-c-d-e-f are expressed in terms of % by mass:

$$32\% \le a \le 66\% \quad (14)$$

$$0.2\% \le b \quad (15)$$

$$0.7\% \le c \le 12\% \quad (16)$$

$$0\% \le d \le 4\% \quad (17)$$

$$0\% \le e \le 10\% \quad (18)$$

$$0\% \le f \le 2\% \quad (19)$$

$$100-a-b-c-d-e-f \le 72.4b \quad (20)$$

and the Ga content of the one or more kinds of main alloy powders is 0.4% by mass or less.

Aspect 4 of the present invention is a preferred aspect in the method for producing an R-T-B based sintered magnet according to the aspect 2, wherein, when $0.40 \le x \le 0.70$, v and w satisfy the following inequality expressions (11) and (7):

$$50w-18.5 \le v \le 50w-16.25 \quad (11)$$

$$-12.5w+38.75 \le v \le -62.5w+86.125 \quad (7)$$

and, when $0.20 \le x < 0.40$, v and w satisfy the following inequality expressions (12) and (9), and x satisfies the following inequality expression (10):

$$50w-18.5 \le v \le 50w-17.0 \quad (12)$$

$$-12.5w+39.125 \le v \le -62.5w+86.125 \quad (9)$$

$$-(62.5w+v-81.625)/15+0.5 \le x \le -(62.5w+v-81.625)/15+0.8 \quad (10).$$

In the aspects 3 and 4 of the present invention, the amount of oxygen of the R-T-B based sintered magnet is preferably 0.15% by mass or less.

Effects of the Invention

According to the aspect of the present invention, it is possible to provide an R-T-B based sintered magnet having high $B_r$ and high $H_{cJ}$ while suppressing the content of Dy or Tb, and a method for producing the same.

MODE FOR CARRYING OUT THE INVENTION

Figure 1:
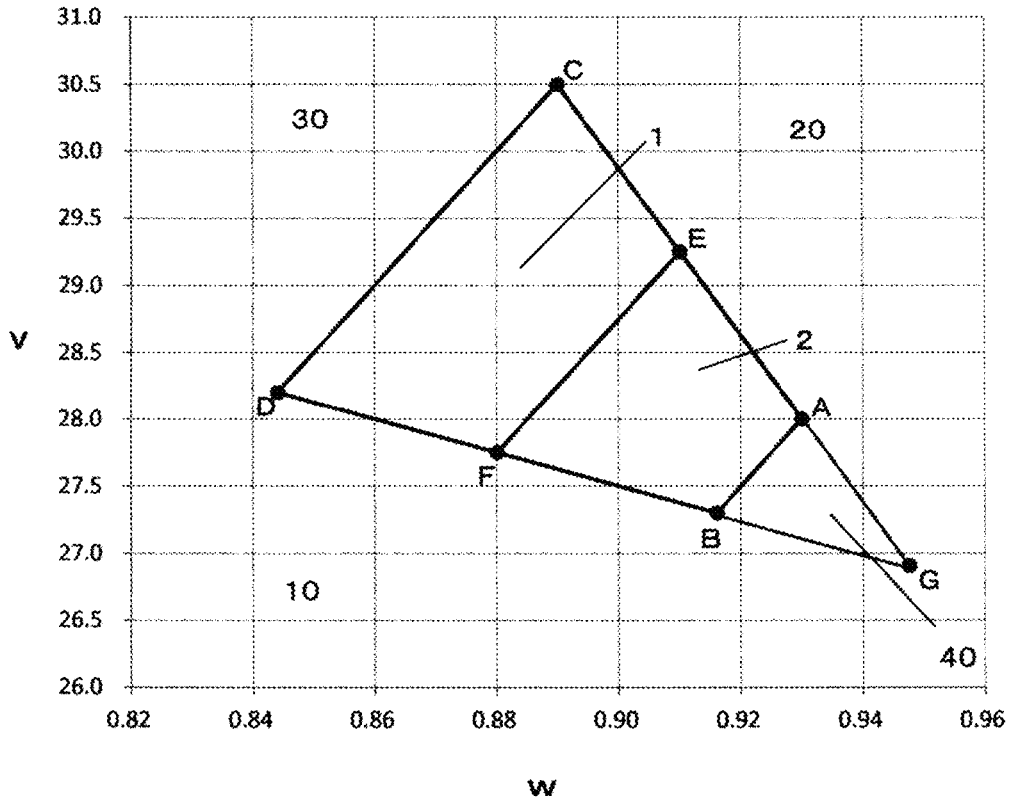
FIG. 1 is an explanatory graph showing ranges of v and w when the amount of Ga is within a range of 0.40% by mass or more and 0.70% by mass or less in one aspect of the present invention.

The inventors have intensively been studied so as to solve the above problems and found that an R-T-B based sintered magnet having high $B_r$ and high $H_{cJ}$ is obtained by the composition represented by the formula shown in the aspect 1 or 2 of the present invention. That is, the present invention is directed to an R-T-B based sintered magnet in which R, B, Ga, Cu, Al, R, B, Ga, Cu, Al, and if necessary, M, are included in a specific proportion shown in the aspect 1 or 2. Although the R-T-B based sintered magnet of the present invention shown in the aspect 1 or 2 can be produced by a known production method, the inventors have found that an R-T-B based sintered magnet having high $B_r$ and high $H_{cJ}$ can be obtained by using an additional alloy powder with a specific composition in a method in which one or more kinds of additional alloy powders and one or more kinds of main alloy powders are mixed with each other in a specific mixing amount, and the mixture thus obtained is compacted, sintered and then subjected to a heat treatment, like the aspect 3 or 4, as preferred aspect in which the R-T-B based sintered magnet shown in the aspect 1 or 2 is produced.

There are still unclear points regarding the mechanism in which an R-T-B based sintered magnet having high $B_r$ and high $H_{cJ}$ is obtained by controlling to the composition in the proportion shown in the aspect 1 or 2 of the present invention, and the mechanism in which an R-T-B based sintered magnet having high $B_r$ and high $H_{cJ}$ is obtained by using an additional alloy powder with a specific composition in a method in which one or more kinds of additional alloy powders and one or more kinds of main alloy powders are mixed with each other in a specific mixing amount, and the mixture thus obtained is compacted, sintered and then subjected to a heat treatment, like the aspect 3 or 4. A description will be made on the mechanism proposed by the inventors based on the findings they have had so far. It is to be noted that the description regarding the following mechanism is not intended to limit the scope of the present invention.

The R-T-B based sintered magnet enables an increase in $B_r$ by increasing an existence ratio of an $R_2T_{14}B$ type compound which is a main phase. To increase the existence ratio of the $R_2T_{14}B$ type compound, the amount of R, the amount of T, and the amount of B may be made closer to a stoichiometric ratio of the $R_2T_{14}B$ type compound. If the amount of B for formation of the $R_2T_{14}B$ type compound is less than the stoichiometric ratio, a soft magnetic $R_2T_{17}$ phase is precipitated on a grain boundary, leading to a rapid reduction in $H_{cJ}$. However, if Ga is included in the magnet composition, an R-T-Ga phase is formed in place of an $R_2T_{17}$ phase, thus enabling prevention of a reduction in $H_{cJ}$.

However, as a result of an intensive study of the inventors, it has been found that the R-T-Ga phase also has slight magnetism and if the R-T-Ga phase excessively exists on the grain boundary in the R-T-B based sintered magnet, particularly the grain boundary existing between two main phases (hereinafter sometimes referred to as a "grain boundary between two grains") which is considered to mainly exert an influence on $H_{cJ}$, magnetism of the R-T-Ga phase prevents $H_{cJ}$ from increasing. It also becomes apparent that the R—Ga phase and the R—Ga—Cu phase are formed on the grain boundary between two grains, together with formation of the R-T-Ga phase. Therefore, it was supposed by the inventors that $H_{cJ}$ is improved by the existence of the R—Ga phase and the R—Ga—Cu phase on the grain boundary between two grains of the R-T-B based sintered magnet. It was also supposed that there is a need to form the R-T-Ga phase so as to form the R—Ga phase and the R—Ga—Cu phase and to eliminate the $R_2T_{17}$ phase, and there is a need to reduce the formation amount so as to obtain high $H_{cJ}$. It was also supposed that $H_{cJ}$ can be further improved if formation of the R-T-Ga phase can be suppressed as small as possible while forming the R—Ga phase and the R—Ga—Cu phase on the grain boundary between two grains.

To reduce the formation amount of the R-T-Ga phase in the R-T-B based sintered magnet, there is a need to suppress the formation amount of the $R_2T_{17}$ phase by setting the amount of R and the amount of B within an appropriate range, and to set the amount of R and the amount of Ga within an optimum range corresponding to the formation amount of the $R_2T_{17}$ phase. However, a part of R is consumed as a result of bonding to oxygen, nitrogen and carbon in the production process of the R-T-B based sintered magnet, so that the actual amount of R used for the $R_2T_{17}$ or R-T-Ga phase varies in the production process. Therefore, it was difficult to suppress the formation amount of the $R_2T_{17}$ or R-T-Ga phase by controlling the amount of R so as to reduce the formation amount while forming the T-Ga phase. The results of an intensive study of the inventors lead to findings that, as shown in the aspect 1 or 2, it is possible to adjust the formation amount of the $R_2T_{17}$ or R-T-Ga phase by using the value (v) obtained by subtracting $6\alpha+10\beta+8\gamma$, where the amount of oxygen (% by mass) of the R-T-B based sintered magnet is $\alpha$, the amount of nitrogen (% by mass) is $\beta$, and the amount of carbon (% by mass) is $\gamma$, from the amount of R(u). It also becomes apparent that high $B_r$ and high $H_{cJ}$ are obtained by including R (the value (v) obtained by subtracting $6\alpha+10\beta+8\gamma$ from the amount of R(u)), B, Ga, Cu, and Al in a specific proportion. Whereby, it is considered to obtain a structure in which large amounts of an R—Ga phase and an R—Ga—Cu phase exist on the grain boundary between two grains in the entire R-T-B based sintered magnet, and also a large amount of a grain boundary between two grains including substantially no R-T-Ga phase existing thereon exists. As a result of obtaining such structure, a reduction in $H_{cJ}$ due to the R-T-Ga phase is suppressed and also the formation amount of the R-T-Ga phase is suppressed, thus making it possible to set the amount of R and the amount of B at the amount to such an extent that does not cause a significant decrease in existence ratio of a main phase, leading to high $B_r$.

The inventors have intensively studied and found that an R-T-B based sintered magnet having high $B_r$ and high $H_{cJ}$ can be obtained by using an additional alloy powder with a specific composition and a main alloy powder having a Ga content of 0.4% by mass or less in a method in which one or more kinds of additional alloy powders and one or more kinds of main alloy powders are mixed with each other in a specific mixing amount, and the mixture thus obtained is compacted, sintered and then subjected to a heat treatment, as preferred aspect in which the R-T-B based sintered magnet is produced. Details are mentioned below.

The composition of the additional alloy powder shown in aspect 3 or 4 of the present invention is the composition in which the amounts of R and B are more than those in $R_2T_{14}B$ stoichiometric composition of the R-T-B based sintered magnet. Therefore, the amount of R or B is relatively more than that of T as compared with the $R_2T_{14}B$ stoichiometric composition. Whereby, the $R_1T_4B_4$ or R—Ga phase and the R—Ga—Cu phase are formed easier than the R-T-Ga phase. The main alloy powder can suppress the amount of Ga or the main phase alloy powder since the additional alloy powder contains a large amount of Ga. Therefore, formation of the R-T-Ga phase in the main alloy powder is also suppressed. Use of the additional alloy powder and the main alloy powder enables significant reduction in the formation amount of the R-T-Ga phase in the stage of an alloy powder. Suppression of the formation amount in the stage of an alloy powder enables suppression of the formation amount of the R-T-Ga phase in the R-T-B based sintered magnet thus obtained finally.

In technology disclosed in Patent Document 1, since the amount of oxygen, the amount of nitrogen, and the amount of carbon are not taken into consideration with respect to the amount of R, it is difficult to suppress the formation amount of the $R_2T_{17}$ or R-T-Ga phase. Technology disclosed in Patent Document 1 is technology in which $H_{cJ}$ is improved by promoting formation of the R-T-Ga phase, and there is not a technical concept for suppressing the formation amount of the R-T-Ga phase. Therefore, there is a need to decrease the amount of B more than before so as to promote formation of the $R_2T_{17}$ phase serving as a raw material of the R-T-Ga phase and to increase the amount of R more than before so as to promote formation of the R-T-Ga phase, so that an existence ratio of the main phase significantly decreases, thus failing to obtain high $B_r$ in Patent Document 1. Furthermore, there is not a technical concept for mixing the additional alloy powder with main alloy powder in Patent Document 1.

[R-T-B Based Sintered Magnet]

A aspect according to the present invention is directed to an R-T-B based sintered magnet represented by the formula:

$$u\mathrm{R}w\mathrm{B}x\mathrm{Ga}y\mathrm{Cu}z\mathrm{Al}q\mathrm{M}(100\text{-}u\text{-}w\text{-}x\text{-}y\text{-}z\text{-}q)\mathrm{T} \quad (1)$$

where

R is composed of light rare-earth element(s) RL and heavy rare-earth element(s) RH, RL is Nd and/or Pr, RH is at least one of Dy, Tb, Gd and Ho, T is Fe, and 10% by mass or less of Fe is capable of being replaced with Co, M is Nb and/or Zr, and u, w, x, y, z, q, and 100-u-w-x-y-z-q are expressed in terms of % by mass, and inevitable impurities are included;

said RH accounts for 5% by mass or less of the R-T-B based sintered magnet, the following inequality expressions (2) to (5) being satisfied:

$$0.20 \le x \le 0.70 \quad (2)$$

$$0.07 \le y \le 0.2 \quad (3)$$

$$0.05 \le z \le 0.5 \quad (4)$$

$$0 \le q \le 0.1 \quad (5)$$

$v=u-(6\alpha+10\beta+8\gamma)$, where the amount of oxygen (% by mass) of the R-T-B based sintered magnet is $\alpha$, the amount of nitrogen (% by mass) is $\beta$, and the amount of carbon (% by mass) is $\gamma$;

when $0.40 \le x \le 0.70$, v and w satisfy the following inequality expressions (6) and (7):

$$50w-18.5 \le v \le 50w-14 \quad (6)$$

$$-12.5w+38.75 \le v \le -62.5w+86.125 \quad (7)$$

and, when $0.20 \le x < 0.40$, v and w satisfy the following inequality expressions (8) and (9), and x satisfies the following inequality expression (10):

$$50w-18.5 \le v \le 50w-15.5 \quad (8)$$

$$-12.5w+39.125 \le v \le -62.5w+86.125 \quad (9)$$

$$-(62.5w+v-81.625)/15+0.5 \le x \le -(62.5w+v-81.625)/15+0.8 \quad (10).$$

Alternatively, an embodiment according to the present invention is directed to an R-T-B based sintered magnet represented by the formula:

$$u\mathrm{R}w\mathrm{B}x\mathrm{Ga}y\mathrm{Cu}z\mathrm{Al}q\mathrm{M}(100\text{-}u\text{-}w\text{-}x\text{-}y\text{-}z\text{-}q)\mathrm{T} \quad (1)$$

where

R is composed of light rare-earth element(s) RL and heavy rare-earth element(s) RH, RL is Nd and/or Pr, RH is at least one of Dy, Tb, Gd and Ho, T is Fe, and 10% by mass or less of Fe is capable of being replaced with Co, M is Nb and/or Zr, u, w, x, y, z, q, and 100-u-w-x-y-z-q are expressed in terms of % by mass, and inevitable impurities are included;

said RH accounts for 5% by mass or less of the R-T-B based sintered magnet, the following inequality expressions (2) to (5) being satisfied:

$$0.20 \le x \le 0.70 \quad (2)$$

$$0.07 \le y \le 0.2 \quad (3)$$

$$0.05 \le z \le 0.5 \quad (4)$$

$$0 \le q \le 0.1 \quad (5)$$

$v=u-(6\alpha+10\beta+8\gamma)$, where the amount of oxygen (% by mass) of the R-T-B based sintered magnet is $\alpha$, the amount of nitrogen (% by mass) is $\beta$, and the amount of carbon (% by mass) is $\gamma$;

when $0.40 \le x \le 0.70$, v and w satisfy the following inequality expressions (11) and (7):

$$50w-18.5 \le v \le 50w-16.25 \quad (11)$$

$$-12.5w+38.75 \le v \le -62.5w+86.125 \quad (7)$$

when $0.20 \le x < 0.40$, v and w satisfy the following inequality expressions (12) and (9):

$$50w-18.5 \le v \le 50w-17.0 \quad (12)$$

$$-12.5w+39.125 \le v \le -62.5w+86.125 \quad (9)$$

and x satisfies the following inequality expression (10):

$$-(62.5w+v-81.625)/15+0.5 \leq x \leq -(62.5w+v-81.625)/15+0.8 \quad (10).$$

The R-T-B based sintered magnet of the present invention may include inevitable impurities. Even if the sintered magnet includes inevitable impurities included normally in a didymium alloy (Nd—Pr), electrolytic iron, ferro-boron, and the like, it is possible to exert the effect of the present invention. The sintered magnet includes, as inevitable impurities, for example, a trace amount of La, Ce, Cr, Mn, Si, and the like.

In one aspect according to the present invention, it is possible to exert the effect that high $B_r$ and high $H_{cJ}$ are obtained by applying the composition represented by the above formula to the R-T-B based sintered magnet. Details are mentioned below.

R in the R-T-B based sintered magnet according to one aspect of the present invention is composed of light rare-earth element(s) RL and a heavy rare-earth element(s) RH, RL is Nd and/or Pr, RH is at least one of Dy, Tb, Gd and Ho, and RH accounts for 5% by mass or less of the R-T-B based sintered magnet. In the present invention, since high $B_r$ and high $H_{cJ}$ can be obtained even when using no heavy rare-earth element, the additive amount of RH can be reduced even when higher $H_{cJ}$ is required. T is Fe, and 10% by mass or less of Fe is capable of being replaced with Co. B is boron.

It has widely been known that, when an attempt is made to obtain a specific rare-earth element, unintentional other rare-earth elements are included as impurities during the process such as refining. Therefore, R in the above-mentioned sentence "R in the R-T-B based sintered magnet according to one aspect of the present invention is composed of light rare-earth element(s) RL and heavy rare-earth element(s) RH, RL is Nd and/or Pr, RH is at least one of Dy, Tb, Gd and Ho, and RH accounts for 5% by mass or less of the R-T-B based sintered magnet" does not completely exclude the case including the rare-earth element except for Nd, Pr, Dy, Tb, Gd and Ho, and means that the rare-earth element except for Nd, Pr, Dy, Tb, Gd and Ho may also be included to the extent to be usually included as impurities.

The amount of oxygen (% by mass), the amount of nitrogen (% by mass) and the amount of carbon (% by mass) in the aspect according to the present invention are the content (namely, the content in case where the mass of the entire R-T-B based magnet is 100% by mass) in the R-T-B based sintered magnet, and the amount of oxygen can be measured using a gas fusion-infrared absorption method, the amount of nitrogen can be measured using a gas fusion-thermal conductivity method, and the amount of carbon can be measured using a combustion infrared absorption method. In the present invention, the value (v), which is obtained by subtracting the amount consumed as a result of bonding to oxygen, nitrogen and carbon from the amount of R(u) using the method described below, is used. Whereby, it becomes possible to adjust the formation amount of the $R_2T_{17}$ or R-T-Ga phase. The above-mentioned v is determined by subtracting $6\alpha+10\beta+8\gamma$, where the amount of oxygen (% by mass) is $\alpha$, the amount of nitrogen (% by mass) is $\beta$, and the amount of carbon (% by mass) is $\gamma$, from the amount of R(u). $6\alpha$ has been defined since an oxide of $R_2O_3$ is mainly formed as impurities, so that R with about 6 times by mass of oxygen is consumed as the oxide. $10\beta$, has been defined since a nitride of RN is mainly formed so that R with about 10 times by mass of nitrogen is consumed as the nitride. $8\gamma$ has been defined since a carbide of $R_2C_3$ is mainly formed so that R with about 8 times by mass of carbon is consumed as the carbide.

The amount of oxygen, the amount of nitrogen, and the amount of carbon are respectively obtained by the measurement using the above-mentioned gas analyzer, whereas u, w, x, y, z and q among u, w, x, y, z, q, and 100-u-w-x-y-z-q, which are the respective contents (% by mass) of R, B, Ga, Cu, Al, M and T shown in the formula (1), may be measured using high-frequency inductively coupled plasma emission spectrometry (ICP optical emission spectrometry, ICP-OES). 100-u-w-x-y-z-q may be determined by calculation using the measured values of u, w, x, y, z and q obtained by ICP optical emission spectrometry.

Accordingly, the formula (1) is defined so that the total amount of elements measurable by ICP optical emission spectrometry becomes 100% by mass. Meanwhile, the amount of oxygen, the amount of nitrogen, and the amount of carbon are unmeasurable by ICP optical emission spectrometry.

Therefore, in the aspect according to the present invention, it is permissible that the total amount of u, w, x, y, z, q, and 100-u-w-x-y-z-q defined in the formula (1), the amount of oxygen ($\alpha$), the amount of nitrogen $\beta$, and the amount of carbon $\gamma$ exceeds 100% by mass.

The amount of oxygen of the R-T-B based sintered magnet is preferably 0.15% by mass or less. Since v is the value obtained by subtracting $6\alpha+10\beta$, $+8\gamma$, where the amount of oxygen (% by mass) is $\alpha$, the amount of nitrogen (% by mass) is $\beta$, and the amount of carbon (% by mass) is $\gamma$ in Table 1, from the amount of R(u), there is a need to increase the amount of R in the stage of the raw material alloy in the case of a large amount of oxygen ($\alpha$). Particularly, among the regions 1 and 2 according to one aspect of the present invention in FIG. 1 mentioned below, the region 1 exhibits relatively higher v than that of the region 2, so that the amount of R may significantly increase in the stage of the raw material alloy in the case of a large amount of oxygen ($\alpha$). Whereby, an existence ratio of a main phase decreases, leading to a reduction in $B_r$. Therefore, in the region 1 of the present invention of FIG. 1, the amount of oxygen is particularly preferably 0.15% by mass or less.

The amount of Ga is 0.20% by mass or more and 0.70% by mass or less. The ranges of v and w vary between the case where the amount of Ga is 0.40% by mass or more and 0.70% by mass or less, and the case where the amount of Ga is 0.20% by mass or more and 0.40% by mass or less. Details are mentioned below.

In one aspect of the present invention, when the amount of Ga is 0.40% by mass or more and 0.70% by mass or less, v and w have the following relationship:

$$50w-18.5 \leq v \leq 50w-14 \quad (6)$$

$$-12.5w+38.75 \leq v \leq -62.5w+86.125 \quad (7)$$

The ranges of v and w satisfying the above inequality expressions (6) and (7) are shown in FIG. 1. v in FIG. 1 is the value obtained by subtracting $6\alpha+10\beta+8\gamma$, where the amount of oxygen (% by mass) is $\alpha$, the amount of nitrogen (% by mass) is $\beta$, and the amount of carbon (% by mass) is $\gamma$, from the amount of R(u), and w is the value of the amount of B. The inequality expression (6), namely, $50w-18.5 \leq v \leq 50w-14$ corresponds to the range held between a straight line including a point A and a point B (straight line connecting a point A with a point B) and a straight line including a point C and a point D (straight line connecting a point C with a point D) in FIG. 1, while the inequality expression (7), namely, $-12.5w+38.75 \leq v \leq -62.5w+86.125$ corresponds to the range held between a straight line including a point D, a point F, a point B and a point G, and a straight line including a point C, a point E, a point A and a point G. The regions 1 and 2 (region surrounded by a point A, a point B, a point D and a point C) satisfying both regions are within the range according to one aspect of the present invention. High $B_r$ and high $H_{cJ}$ can be obtained by adjusting v and w within the range of the regions 1 and 2. It is considered that, regarding the region 10 (region below from a straight line including a point D, a point F, a point B and a point G in the drawing) which deviates from the range of the regions 1 and 2, the formation amount of the R-T-Ga phase decreases since v is too smaller than w, thus failing to remove the $R_2T_{17}$ phase, or failing to a reduction in the formation amount of the R—Ga phase the and R—Ga—Cu phase. Whereby, high $H_{cJ}$ cannot be obtained. Meanwhile, regarding the region 20 (region above from a straight line including a point C, a point E, a point A and a point G in the drawing) which deviates from the range of the regions 1 and 2, the amount of Fe is relatively deficient since w is too larger than v. If the amount of Fe is deficient, R and B become excessive, thus failing to form the R-T-Ga phase, leading to formation of the $R_1Fe_4B_4$ phase. Whereby, the formation amounts of the R—Ga phase and the R—Ga—Cu phase decrease, thus failing to obtain high $H_{cJ}$. Furthermore, in the region 30 (region above from straight line including a point C and a point D in the drawing) deviating from the range of the regions 1 and 2, the R-T-Ga or R—Ga phase and the R—Ga—Cu phase are formed since v is too large and also w is too small, and an existence ratio of the main phase decreases, thus failing to obtain high $B_r$. Furthermore, in the region 40 (region where the regions 1 and 2 are removed from the region surrounded by a point C, a point D and a point G) deviating from the range of the regions 1 and 2, an existence ratio of the main phase is high, while the R-T-Ga phase is scarcely formed since the amount of R is too small and also the amount of B is too large, and an existence ratio of the R—Ga phase and the R—Ga—Cu phase decreases, thus failing to obtain high $H_{cJ}$.

In one aspect of the present invention, when the amount of Ga is 0.20% by mass or more and less than 0.40% by mass, v and w have the following relationship:

$$50w-18.5 \le v \le 50w-15.5 \quad (8)$$

$$-12.5w+39.125 \le v \le -62.5w+86.125 \quad (9)$$

Figure 2:
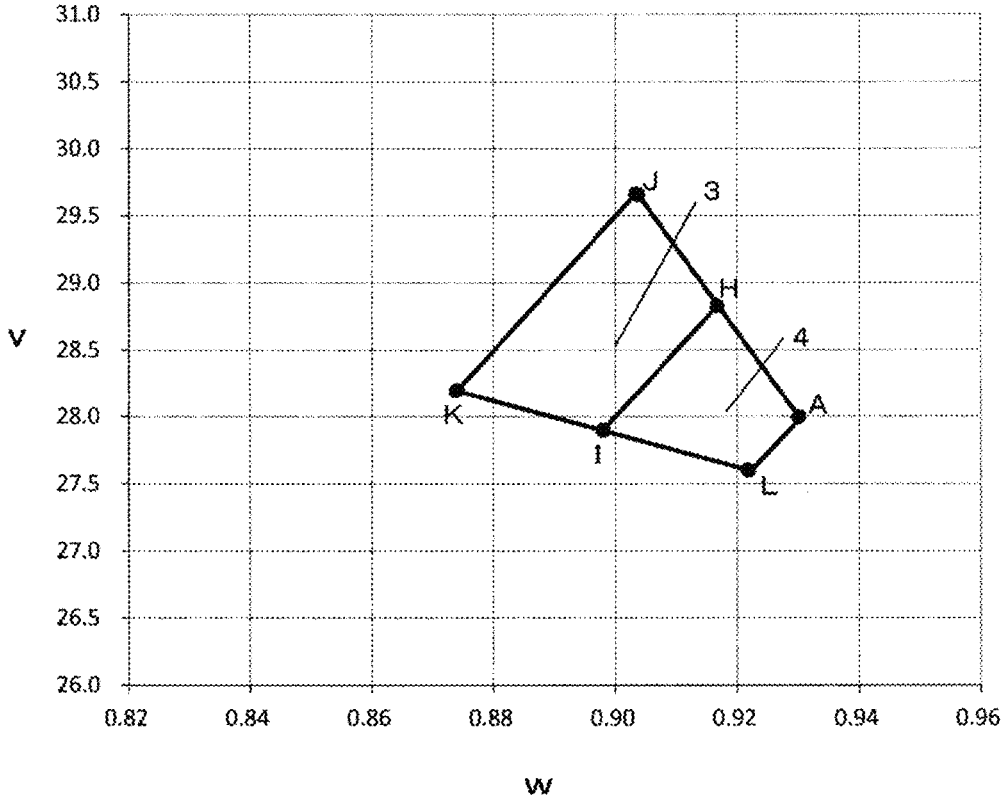
FIG. 2 is an explanatory graph showing ranges of v and w when the amount of Ga is within a range of 0.20% by mass or more and less than 0.40% by mass in one aspect of the present invention.
Figure 3:
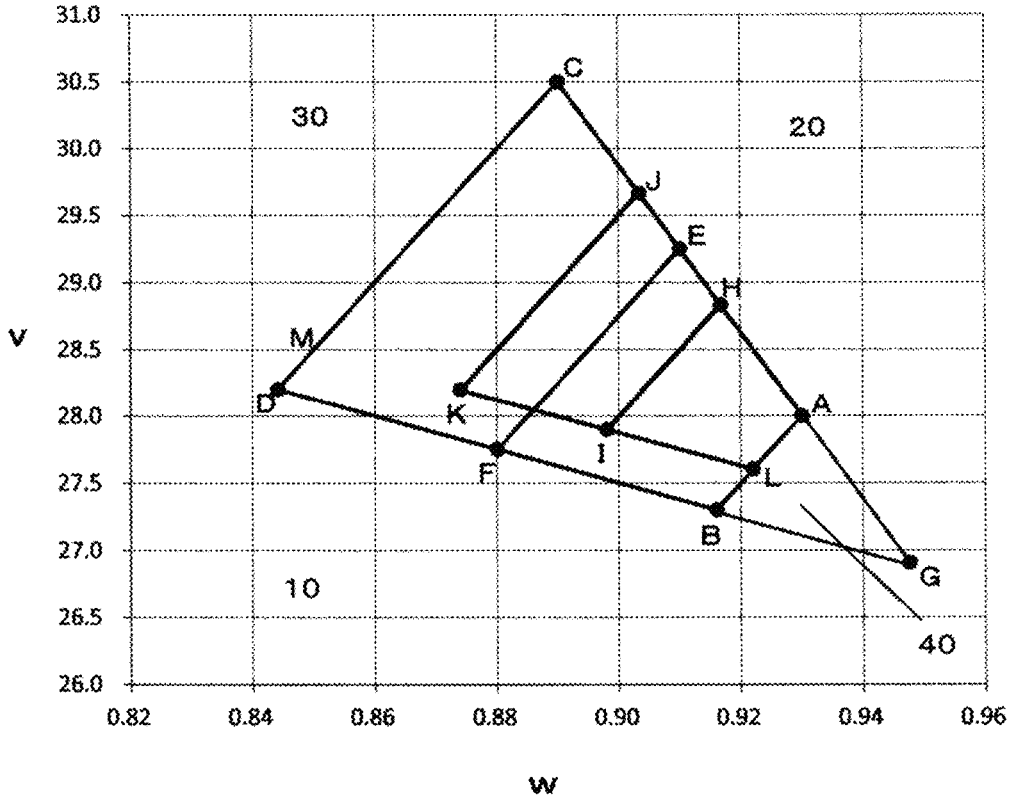
FIG. 3 is an explanatory graph showing the relative relationship between ranges shown in FIG. 1 and ranges shown in FIG. 2.

The ranges of the present invention of v and w, which satisfy the inequality expressions (8) and (9), are shown in FIG. 2. The inequality expression (8), namely, 50w−18.5≤v≤50w−15.5 corresponds to the range held between a straight line including a point A and a point L and a straight line including a point J and a point K in FIG. 2, and the inequality expression (9), namely, −12.5w+39.125≤v≤−62.5w+86.125 corresponds to the range held between a straight line including a point K, a point I and a point L, and a straight line including a point J, a point H and a point A. The regions 3 and 4 (region surrounded by a point A, a point L, a point K and a point J) satisfying both regions are within the range according to one aspect of the present invention. For your reference, the positional relationship (relative relationship between the range shown in FIG. 1 and the range shown in FIG. 2) between FIG. 1 (when the amount of Ga is 0.40% by mass or more and 0.70% or less by mass or less) and FIG. 2 (when the amount of Ga is 0.20% by mass or more and less than 0.40% by mass) is shown in FIG. 3. Even if x(Ga) is 0.20% by mass or more and less than 0.40% by mass, high $B_r$ and high $H_{cJ}$ can be obtained by setting appropriate x in accordance with v and w mentioned below within the above range (regions 3 and 4 surrounded by a point A, a point L, a point K and a point J).

If x is 0.20% by mass or more and less than 0.40% by mass, in one aspect of the present invention, x is adjusted within the range of the following inequality expression (10) in accordance with v and w:

$$-(62.5w+v-81.625)/15+0.5 \le x \le -(62.5w+v-81.625)/15+0.8 \quad (10).$$

By adjusting x within the range of the inequality expression (10) in accordance with v and w, it is possible to form the R-T-Ga phase minimally necessary for obtaining high magnetic properties. If x is less than the above range, $H_{cJ}$ may decrease because of too small formation amount of the R-T-Ga phase. Meanwhile, if x exceeds the above range, unnecessary Ga exists and an existence ratio of the main phase may decrease, leading to a reduction in $B_r$.

In the present invention, when the amount of Ga is 0.40% by mass or more and 0.70% by mass or less, more preferably, v and w have the following relationship:

$$50w-18.5 \le v \le 50w-16.25 \quad (11)$$

$$-12.5w+38.75 \le v \le -62.5w+86.125 \quad (7).$$

The ranges of v and w, which satisfy the inequality expressions (11) and (7), are shown in FIG. 1. The inequality expression (11), namely, 50w−18.5≤v≤50w−16.25 corresponds to the range held between a straight line including a point A and a point B, and a straight line including a point E and a point F, and the inequality expression (7), namely, −12.5w+38.75≤v≤−62.5w+86.125 corresponds to the range held between a straight line including a point D, a point F, a point B and a point G, and a straight line including a point C, a point E, a point A and a point G. The region 2 (region surrounded by a point A, a point B, a point F and a point E) satisfying both regions is within the range of the present invention. With the above composition, it is possible to decrease v and to increase w while securing the formation amount of the R-T-Ga phase, so that an existence ratio of a main phase does not decrease, thus obtaining higher $B_r$.

In the present invention, when the amount of Ga is 0.20% by mass or more and less than 0.40% by mass, more preferably, x and w have the relationship of the following inequality expressions (12) and (9).

$$50w-18.5 \le v \le 50w-17.0 \quad (12)$$

$$-12.5w+39.125 \le v \le -62.5w+86.125 \quad (9)$$

The range, which satisfies the inequality expressions (12) and (9), is shown in FIG. 2. The inequality expression (12), namely, 50w−18.5≤v≤50w−17.0 corresponds to the range held between a straight line including a point A and a point L, and a straight line including a point H and a point I, and the inequality expression (9), namely, −12.5w+39.125≤v≤−62.5w+86.125 corresponds to the range held between a straight line including a point K, a point I and a point L, and a straight line including a point J, a point H and a point A. The region 4 (region surrounded by a point A, a point L, a point I and a point H) satisfying both regions is within the range according to one aspect of the present invention. For your reference, the relative positional relationship between FIG. 1 (the amount of Ga is 0.40% by mass or more and 0.70% by mass or less) and FIG. 2 (the amount of Ga is 0.20% by mass or more and less than 0.40% by mass) is shown in FIG. 3. By adjusting within the above range (region 4 surrounded by a point A, a point L, a point I and a point H) and also adjusting x within the rage of −(62.5w+ v−81.625)/15+0.5≤x≤−(62.5w+v−81.625)/15+0.8 as mentioned above, it is possible to decrease v and to increase w while securing the formation amount of the R-T-Ga phase, so that an existence ratio of the main phase is not decreased, thus obtaining higher $B_r$.

Cu is preferably included in the amount of 0.07% by mass or more and 0.2% by mass or less. If the content of Cu is less than 0.07% by mass, the R—Ga phase and the R—Ga—Cu phase may not be easily formed on the grain boundary between two grains, thus failing to obtain high $H_{cJ}$. If the content of Cu exceeds 0.2% by mass, the content of Cu may be too large to perform sintering. The content of Cu is more preferably 0.08% by mass or more and 0.15% by mass or less.

Al (0.05% by mass or more 0.5% by mass or less) may also be included to the extent to be usually included. $H_{cJ}$ can be improved by including Al. In the production process, 0.05% by mass or more of Al is usually included as inevitable impurities, and may be included in the total amount (the amount of Al included as inevitable impurities and the amount of intentionally added Al) of 0.5% by mass or less.

It has generally been known that abnormal grain growth of crystal grains during sintering is suppressed by including Nb and/or Zr in the R-T-B based sintered magnet. In the present invention, Nb and/or Zr may be included in the total amount of 0.1% by mass or less. If the total content of Nb and/or Zr exceeds 0.1% by mass, a volume fraction of the main phase may be decreased by the existence of unnecessary Nb and/or Zr, leading to a reduction in $B_r$.

In one aspect of the present invention, the R-T-Ga phase includes: R: 15% by mass or more and 65% by mass or less, T: 20% by mass or more and 80% by mass or less, and Ga: 2% by mass or more and 20% by mass or less, and examples thereof include an $R_6Fe_{13}Ga_1$ compound. The R-T-Ga phase sometimes includes, as inevitable impurities, Al, Cu and Si, and is sometimes, for example, an $R_6Fe_{13}(Ga_{1-x-y-z}Cu_xAl_ySi_z)$ compound. The R—Ga phase includes: R: 70% by mass or more 95% by mass or less, Ga: 5% by mass or more 30% by mass or less, and T(Fe): 20% by mass or less (including 0), and examples thereof include an $R_3Ga_1$ compound. Furthermore, the R—Ga—Cu phase is obtained by replacing a part of the R—Ga phase of Ga with Cu, and examples thereof include an $R_3(Ga,Cu)_1$ compound.

[Method for Producing R-T-B Based Sintered Magnet]

As mentioned above, the R-T-B based sintered magnet of the present invention shown in the aspect 1 or 2 may be produced using a known production method.

An example of a method for producing an R-T-B based sintered magnet will be described. The method for producing an R-T-B based sintered magnet includes a step of obtaining an alloy powder, a compacting step, a sintering step, and a heat treatment step. Each step will be described below.

(1) Step of Obtaining Alloy Powder

A kind of an alloy powder (single alloy powder) may be used as an alloy powder. A so-called two-alloy method of obtaining an alloy powder (mixed alloy powder) by mixing two or more kinds of alloy powders may be used to obtain an alloy powder with the composition of the present invention using the known method.

In the case of the single alloy powder, metals or alloys of the respective elements are prepared so as to obtain the above-mentioned composition, and a flaky alloy is produced from them using a strip casting method. The flaky alloy thus obtained is subjected to hydrogen grinding to obtain a coarsely pulverized powder having a size of 1.0 mm or less. Next, the coarsely pulverized powder is finely pulverized by a jet mill to obtain a finely pulverized powder (single alloy powder) having a grain size $D_{50}$ (value obtained by a laser diffraction method using an air flow dispersion method (median size on a volume basis)) of 3 to 7 μm. A known lubricant may be used as a pulverization assistant in a coarsely pulverized powder before jet mill pulverization, or an alloy powder during and after jet mill pulverization.

When using the mixed alloy powder, in preferred aspect, as shown below, one or more kinds of additional alloy powders and one or more kinds of main alloy powders are prepared first, and then one or more kinds of additional alloy powders are mixed with one or more kinds of main alloy powders in a specific mixing amount to obtain a mixed alloy powder.

Metals or alloys of the respective elements are prepared so as to obtain a given composition mentioned in detail below from one or more kinds of additional alloy powders and one or more kinds of main alloy powders. In the same manner as in the above-mentioned single alloy powder, a flaky alloy is produced and then the flaky alloy is subjected to hydrogen grinding to obtain a coarsely pulverized powder. The additional alloy powder (coarsely pulverized powder of additional alloy powder) and the main alloy powder (coarsely pulverized powder of main alloy powder) are loaded in a V-type mixer, followed by mixing to obtain a mixed alloy powder. When mixing at the stage of the coarsely pulverized powder in this way, the mixed alloy powder thus obtained is finely pulverized by a jet mill to obtain a finely pulverized powder, thus obtaining a mixed alloy powder. As a matter of course, the additional alloy powder and the main alloy powder may be respectively finely pulverized by a jet mill to obtain a finely pulverized powder, which is then mixed to obtain a mixed alloy powder. If a large amount of R of the additional alloy powder is mixed, since ignition easily occurs during fine pulverization, the additional alloy powder and the main alloy powder are preferably finely pulverized after mixing.

Here, the "additional alloy powder" has the composition within the range mentioned in detail below. Plural kinds of additional alloy powders may be used. In that case, each additional alloy powder has the composition within the range mentioned in detail below. The "main alloy powder" means an alloy powder which has the composition deviating from the range of the composition of the additional alloy powder, and also prepared so as to obtain the composition of the above-mentioned R-T-B based sintered magnet by mixing with the additional alloy powder. Plural kinds of main alloy powders may be used. In that case, it must be a main alloy powder which has the composition deviating from the composition of the additional alloy powder, and also prepared so as to obtain the composition of the above-mentioned R-T-B based sintered magnet by mixing plural kinds of main alloy powders with the additional alloy powder.

[Additional Alloy Powder]

In preferred aspect, the additional alloy powder is represented by the formula:

$$aRbBcGadCueAlfM(100-a-b-c-d-e-f)T \quad (13)$$

and has the composition represented by:

$$32\% \le a \le 66\% \quad (14)$$

$$0.2\% \le b \quad (15)$$

$$0.7\% \le c \le 12\% \quad (16)$$

$$0\% \le d \le 4\% \quad (17)$$

$$0\% \leq e \leq 10\% \quad (18)$$

$$0\% \leq f \leq 2\% \quad (19)$$

$$100\text{-}a\text{-}b\text{-}c\text{-}d\text{-}e\text{-}f \leq 72.4b \quad (20)$$

and balance T (R is composed of light rare-earth element(s) RL and heavy rare-earth element(s) RH, RL is Nd and/or Pr, RH is at least one of Dy, Tb, Gd and Ho, T is Fe, and 10% by mass or less of Fe is capable of being replaced with Co, M is Nb and/or Zr, a, b, c, d, e, f and 100-a-b-c-d-e-f are expressed in terms of % by mass, and inevitable impurities are included).

With the above composition, the additional alloy powder has the composition in which the amounts of R and B are relatively more than those of the $R_2T_{14}B$ stoichiometric composition. Therefore, the $R_1T_4B_4$ phase and R—Ga phase are formed easier than the R-T-Ga phase.

If the amount of R(a) is less than 32% by mass, the amount of R is relatively too small relative to the $R_2T_{14}B$ stoichiometric composition, thus making it difficult to form the R—Ga phase. Whereas, if the amount of R(a) exceeds 66% by mass, a problem of oxidation arises because of too large amount of R to thereby cause deterioration of magnetic properties and risk of ignition, resulting in production problems.

If the amount of B(b) is less than 0.2% by mass, the amount of B is relatively too small relative to the $R_2T_{14}B$ stoichiometric composition, so that the R-T-Ga phase is formed easier than the $R_1T_4B_4$ phase.

If the amount of Ga(c) is less than 0.7% by mass, the R—Ga phase may not easily formed, whereas, if the amount of Ga(c) exceeds 12% by mass, Ga may be segregated, thus failing to obtain an R-T-B based sintered magnet having high $H_{cJ}$.

The additional alloy powder satisfies the inequality expression (20), namely, the relationship: 100-a-b-c-d-e-f≤72.4b. The composition in which the amount of B is more than that of T(Fe) relative to the $R_2T_{14}B$ stoichiometric composition is obtained by satisfying the relationship of the inequality expression (20). Therefore, the $R_1T_4B_4$ phase and the R—Ga phase are easily formed, thus making it possible to suppress formation of the R-T-Ga phase.

The additional alloy powder has higher Ga content than that of the main alloy powder. The reason is that formation of the R-T-Ga phase in the main alloy powder may not be suppressed if the Ga content of the additional alloy powder is lower than that of the main alloy powder. The additional alloy powder may be one kind of an alloy powder, or may be composed of two or more kinds of alloy powders each having a different composition. When using two or more kinds of additional alloy powders, the composition falls within the above range in all additional alloy powders.

[Main Alloy Powder]

In preferred aspect, the Ga content of the main alloy powder is 0.4% by mass or less, and the main alloy powder is produced with optional composition adjusted so as to obtain an R-T-B based sintered magnet with the composition of the present invention by mixing with the additional alloy powder. If the Ga content of the main alloy powder exceeds 0.4% by mass, formation of the R-T-Ga phase in the main alloy powder may not be suppressed. The main alloy powder may be one kind of an alloy powder, or may be composed of two or more kinds of alloy powders each having a different composition.

In preferred aspect of the present invention, the mixing amount of the additional alloy powder in the mixed alloy powder is within a range of 0.5% by mass or more and 40% by mass or less based on 100% by mass of the mixed alloy powder. The R-T-B based sintered magnet produced by controlling the mixing amount of the additional alloy powder within the above range can exhibit high $B_r$ and high $H_{cJ}$.

(2) Compacting Step

Using the alloy powder thus obtained (single alloy powder or mixed alloy powder), compacting under a magnetic field is performed to obtain a compact. The compacting under a magnetic field may be performed using any known methods of compacting under a magnetic field including a dry compacting method in which a dry alloy powder is loaded in a cavity of a mold and then compacted while applying a magnetic field, and a wet compacting method in which a slurry (containing the alloy powder dispersed therein) is injected in a cavity of a mold and then compacted while discharging a dispersion medium of the slurry.

(3) Sintering Step

The compact is sintered to obtain a sintered body. A known method can be used to sinter the compact. To prevent oxidation from occurring due to an atmosphere during sintering, sintering is preferably performed in a vacuum atmosphere or an atmospheric gas. It is preferable to use, as the atmospheric gas, an inert gas such as helium or argon.

(4) Heat Treatment Step

The sintered body thus obtained is preferably subjected to a heat treatment for the purpose of improving magnetic properties. Known conditions can be employed for the heat treatment temperature and the heat treatment time. To adjust the size of the sintered magnet, the obtained sintered magnet may be subjected to machining such as grinding. In that case, the heat treatment may be performed before or after machining. The sintered magnet may also be subjected to a surface treatment. The surface treatment may be a known surface treatment, and it is possible to perform surface treatments, for example, Al vapor deposition, Ni electroplating, resin coating, and the like.

EXAMPLES

The present invention will be described in more detail below by way of Examples, but the present invention is not limited thereto.

Example 1

Nd metal, Pr metal, Dy metal, Tb metal, ferroboron alloy, electrolytic Co, Al metal, Cu metal, Ga metal, ferro-niobium alloy, ferro-zirconium alloy and electrolytic iron (any of metals has a purity of 99% by mass or more) were mixed so as to obtain a given composition, and then these raw materials were melted and subjected to casting by a strip casting method to obtain a flaky alloy having a thickness of 0.2 to 0.4 mm. The flaky alloy thus obtained was subjected to hydrogen grinding in a hydrogen atmosphere under an increased pressure and then subjected to a dehydrogenation treatment of heating to 550° C. in vacuum and cooling to obtain a coarsely pulverized powder. To the coarsely pulverized powder thus obtained, zinc stearate was added as a lubricant in the proportion of 0.04% by mass based on 100% by mass of the coarsely pulverized powder, followed by mixing. Using an air flow-type pulverizer (jet milling machine), the mixture was subjected to dry pulverization in a nitrogen gas flow to obtain a finely pulverized powder (alloy powder) having a grain size $D_{50}$ of 4 μm. By mixing the nitrogen gas with atmospheric air during pulverization, the oxygen concentration in a nitrogen gas during pulverization was adjusted. When mixing with no atmospheric air, the oxygen concentration in the nitrogen gas during pulverization is 50 ppm or less and the oxygen concentration in the nitrogen gas was increased to 5,000 ppm at a maximum by mixing with atmospheric air to produce finely pulverized powders each having a different oxygen amount. The grain size $D_{50}$ is a median size on a volume basis obtained by a laser diffraction method using an air flow dispersion method. In Table 1, O (amount of oxygen) was measured by a gas fusion-infrared absorption method, N (amount of nitrogen) was measured by a gas fusion-thermal conductivity method, and C (amount of carbon) was measured by a combustion infrared absorption method, using a gas analyzer.

To the finely pulverized powder, zinc stearate was added as a lubricant in the proportion of 0.05% by mass based on 100% by mass of the finely pulverized powder, followed by mixing and further compacting in a magnetic field to obtain a compact. A compacting device used was a so-called perpendicular magnetic field compacting device (transverse magnetic field compacting device) in which a magnetic field application direction and a pressuring direction are perpendicular to each other.

The compact thus obtained was sintered in vacuum at 1,020° C. for 4 hours and then quenched to obtain an R-T-B-based sintered magnet. The sintered magnet had a density of 7.5 $Mg/m^3$ or more. To determine a composition of the sintered magnet thus obtained, the contents of Nd, Pr, Dy, Tb, B, Co, Al, Cu, Ga, Nb and Zr were measured by ICP optical emission spectrometry. The measurement results are shown in Table 1. Balance (obtained by subtracting the contents of Nd, Pr, Dy, Tb, B, Co, Al, Cu, Ga, Nb and Zr, obtained as a result of the measurement, from 100% by mass) was regarded as the content of Fe. Furthermore, gas analysis results (O, N and C) are shown in Table 1. The sintered body was subjected to a heat treatment of retaining at 800° C. for 2 hours and cooling to room temperature, followed by retention at 500° C. for 2 hours and cooling to room temperature. The sintered magnet thus obtained after the heat treatment was machined to produce samples of 7 mm in length×7 mm in width×7 mm in thickness, and then $B_r$ and $H_{cJ}$ of each sample were measured by a B—H tracer. The measurements results are shown in Table 2.

TABLE 1

| | Analysis results of R-T-B-based sintered magnet (% by mass) | | | | | | | | | | | | | | | |
|---|---|---|---|---|---|---|---|---|---|---|---|---|---|---|---|---|
| No. | Nd | Pr | Dy | Tb | B | Co | Al | Cu | Ga | Nb | Zr | Fe | O | N | C | |
| 01 | 22.7 | 7.4 | 0 | 0 | 0.910 | 0.5 | 0.10 | 0.08 | 0.47 | 0.00 | 0.00 | bal. | 0.10 | 0.05 | 0.10 | Present invention |
| 02 | 22.7 | 7.4 | 0 | 0 | 0.910 | 0.5 | 0.05 | 0.08 | 0.47 | 0.00 | 0.00 | bal. | 0.10 | 0.05 | 0.10 | Present invention |
| 03 | 22.7 | 7.4 | 0 | 0 | 0.910 | 2.0 | 0.10 | 0.08 | 0.47 | 0.00 | 0.00 | bal. | 0.10 | 0.05 | 0.10 | Present invention |
| 04 | 22.7 | 7.4 | 0 | 0 | 0.910 | 0.5 | 0.05 | 0.08 | 0.42 | 0.10 | 0.00 | bal. | 0.10 | 0.05 | 0.10 | Present invention |
| 05 | 22.7 | 7.4 | 0 | 0 | 0.910 | 0.5 | 0.05 | 0.08 | 0.41 | 0.00 | 0.10 | bal. | 0.10 | 0.05 | 0.10 | Present invention |
| 06 | 22.7 | 7.4 | 0 | 0 | 0.910 | 0.5 | 0.05 | 0.08 | 0.40 | 0.03 | 0.05 | bal. | 0.10 | 0.05 | 0.10 | Present invention |
| 07 | 22.7 | 7.4 | 0 | 0 | 0.910 | 0.5 | 0.10 | 0.08 | 0.43 | 0.00 | 0.00 | bal. | 0.10 | 0.05 | 0.10 | Present invention |
| 08 | 22.7 | 7.4 | 0 | 0 | 0.905 | 0.5 | 0.10 | 0.08 | 0.26 | 0.00 | 0.00 | bal. | 0.10 | 0.05 | 0.10 | Comparative Example |
| 09 | 22.7 | 7.4 | 0 | 0 | 0.910 | 0.5 | 0.10 | 0.08 | 0.70 | 0.00 | 0.00 | bal. | 0.10 | 0.05 | 0.10 | Present invention |
| 10 | 22.7 | 7.4 | 0 | 0 | 0.910 | 0.0 | 0.10 | 0.08 | 0.47 | 0.00 | 0.00 | bal. | 0.10 | 0.05 | 0.10 | Present invention |
| 11 | 23.0 | 7.6 | 0 | 0 | 0.910 | 0.5 | 0.10 | 0.12 | 0.46 | 0.00 | 0.00 | bal. | 0.39 | 0.01 | 0.08 | Present invention |
| 12 | 23.0 | 7.6 | 0 | 0 | 0.907 | 0.5 | 0.10 | 0.12 | 0.48 | 0.00 | 0.00 | bal. | 0.44 | 0.01 | 0.08 | Comparative Example |
| 13 | 23.0 | 7.6 | 0 | 0 | 0.905 | 0.5 | 0.10 | 0.12 | 0.46 | 0.00 | 0.00 | bal. | 0.08 | 0.04 | 0.09 | Present invention |
| 14 | 23.1 | 7.6 | 0 | 0 | 0.937 | 0.5 | 0.10 | 0.13 | 0.47 | 0.00 | 0.00 | bal. | 0.08 | 0.04 | 0.09 | Comparative Example |
| 15 | 23.1 | 7.6 | 0 | 0 | 0.920 | 0.5 | 0.10 | 0.12 | 0.47 | 0.00 | 0.00 | bal. | 0.08 | 0.05 | 0.09 | Comparative Example |
| 16 | 23.1 | 7.6 | 0 | 0 | 0.878 | 0.5 | 0.10 | 0.12 | 0.48 | 0.00 | 0.00 | bal. | 0.41 | 0.01 | 0.08 | Comparative Example |
| 17 | 23.0 | 7.7 | 0 | 0 | 0.930 | 0.5 | 0.10 | 0.13 | 0.48 | 0.00 | 0.00 | bal. | 0.41 | 0.01 | 0.08 | Comparative Example |
| 18 | 23.0 | 7.7 | 0 | 0 | 0.897 | 0.5 | 0.10 | 0.12 | 0.47 | 0.00 | 0.00 | bal. | 0.40 | 0.01 | 0.08 | Present invention |
| 19 | 23.1 | 7.6 | 0 | 0 | 0.937 | 0.5 | 0.10 | 0.14 | 0.50 | 0.00 | 0.00 | bal. | 0.24 | 0.03 | 0.08 | Comparative Example |
| 20 | 23.1 | 7.7 | 0 | 0 | 0.887 | 0.5 | 0.10 | 0.12 | 0.47 | 0.00 | 0.00 | bal. | 0.39 | 0.01 | 0.07 | Present invention |
| 21 | 23.1 | 7.7 | 0 | 0 | 0.894 | 0.5 | 0.10 | 0.12 | 0.50 | 0.00 | 0.00 | bal. | 0.07 | 0.05 | 0.09 | Present invention |
| 22 | 23.1 | 7.7 | 0 | 0 | 0.860 | 0.5 | 0.10 | 0.12 | 0.47 | 0.00 | 0.00 | bal. | 0.39 | 0.01 | 0.09 | Comparative Example |
| 23 | 23.1 | 7.7 | 0 | 0 | 0.937 | 0.5 | 0.10 | 0.13 | 0.10 | 0.00 | 0.00 | bal. | 0.43 | 0.01 | 0.08 | Comparative Example |
| 24 | 23.4 | 7.4 | 0 | 0 | 0.974 | 0.5 | 0.10 | 0.15 | 0.49 | 0.00 | 0.00 | bal. | 0.08 | 0.04 | 0.09 | Comparative Example |
| 25 | 23.2 | 7.7 | 0 | 0 | 0.850 | 0.5 | 0.10 | 0.16 | 0.51 | 0.00 | 0.00 | bal. | 0.24 | 0.03 | 0.09 | Present invention |
| 26 | 23.2 | 7.6 | 0 | 0 | 0.918 | 0.5 | 0.10 | 0.13 | 0.49 | 0.00 | 0.00 | bal. | 0.23 | 0.03 | 0.08 | Present invention |
| 27 | 23.2 | 7.7 | 0 | 0 | 0.850 | 0.5 | 0.10 | 0.12 | 0.52 | 0.00 | 0.00 | bal. | 0.08 | 0.06 | 0.09 | Comparative Example |
| 28 | 23.2 | 7.7 | 0 | 0 | 0.875 | 0.5 | 0.10 | 0.20 | 0.55 | 0.00 | 0.00 | bal. | 0.08 | 0.04 | 0.09 | Present invention |
| 29 | 23.3 | 7.6 | 0 | 0 | 0.890 | 0.5 | 0.10 | 0.15 | 0.45 | 0.00 | 0.00 | bal. | 0.22 | 0.04 | 0.08 | Present invention |
| 30 | 23.4 | 7.6 | 0 | 0 | 0.896 | 0.5 | 0.10 | 0.15 | 0.10 | 0.00 | 0.00 | bal. | 0.08 | 0.05 | 0.10 | Comparative Example |
| 31 | 23.4 | 7.6 | 0 | 0 | 0.904 | 0.5 | 0.10 | 0.16 | 0.49 | 0.00 | 0.09 | bal. | 0.07 | 0.05 | 0.11 | Present invention |
| 32 | 23.3 | 7.9 | 0 | 0 | 0.830 | 0.5 | 0.20 | 0.11 | 0.15 | 0.00 | 0.00 | bal. | 0.10 | 0.05 | 0.09 | Comparative Example |
| 33 | 23.3 | 7.9 | 0 | 0 | 0.830 | 0.5 | 0.20 | 0.11 | 0.15 | 0.00 | 0.00 | bal. | 0.40 | 0.02 | 0.09 | Comparative Example |
| 34 | 23.6 | 7.7 | 0 | 0 | 0.883 | 0.5 | 0.10 | 0.15 | 0.48 | 0.00 | 0.00 | bal. | 0.08 | 0.05 | 0.11 | Present invention |
| 35 | 23.7 | 7.6 | 0 | 0 | 0.910 | 0.5 | 0.10 | 0.15 | 0.51 | 0.00 | 0.00 | bal. | 0.09 | 0.05 | 0.10 | Comparative Example |
| 36 | 23.6 | 7.7 | 0 | 0 | 0.891 | 0.5 | 0.10 | 0.15 | 0.94 | 0.00 | 0.00 | bal. | 0.08 | 0.05 | 0.10 | Comparative Example |
| 37 | 23.6 | 7.8 | 0 | 0 | 0.890 | 0.5 | 0.10 | 0.16 | 0.50 | 0.00 | 0.00 | bal. | 0.07 | 0.03 | 0.07 | Present invention |
| 38 | 23.7 | 7.7 | 0 | 0 | 0.910 | 0.5 | 0.10 | 0.15 | 0.51 | 0.00 | 0.00 | bal. | 0.08 | 0.04 | 0.08 | Comparative Example |
| 39 | 24.0 | 8.0 | 0 | 0 | 0.870 | 0.5 | 0.20 | 0.05 | 0.57 | 0.00 | 0.00 | bal. | 0.10 | 0.05 | 0.09 | Comparative Example |
| 40 | 24.0 | 8.0 | 0 | 0 | 0.870 | 0.5 | 0.20 | 0.05 | 0.57 | 0.00 | 0.00 | bal. | 0.43 | 0.02 | 0.09 | Comparative Example |
| 41 | 24.0 | 8.0 | 0 | 0 | 0.860 | 0.5 | 0.20 | 0.30 | 0.57 | 0.00 | 0.00 | bal. | 0.10 | 0.05 | 0.09 | Comparative Example |
| 42 | 24.0 | 8.0 | 0 | 0 | 0.860 | 0.5 | 0.20 | 0.30 | 0.57 | 0.00 | 0.00 | bal. | 0.41 | 0.02 | 0.09 | Comparative Example |
| 43 | 24.2 | 8.1 | 0 | 0 | 0.900 | 0.5 | 0.10 | 0.14 | 0.45 | 0.00 | 0.00 | bal. | 0.09 | 0.05 | 0.11 | Comparative Example |
| 44 | 24.3 | 8.2 | 0 | 0 | 0.883 | 0.5 | 0.10 | 0.13 | 0.46 | 0.00 | 0.00 | bal. | 0.10 | 0.05 | 0.11 | Comparative Example |
| 45 | 24.5 | 8.3 | 0 | 0 | 0.937 | 0.5 | 0.10 | 0.13 | 0.10 | 0.00 | 0.00 | bal. | 0.43 | 0.01 | 0.08 | Comparative Example |
| 46 | 23.0 | 7.6 | 0 | 0 | 0.923 | 0.5 | 0.10 | 0.12 | 0.48 | 0.00 | 0.00 | bal. | 0.39 | 0.01 | 0.08 | Comparative Example |
| 47 | 21.3 | 7.0 | 2 | 0 | 0.940 | 0.5 | 0.10 | 0.13 | 0.10 | 0.00 | 0.00 | bal. | 0.10 | 0.05 | 0.10 | Comparative Example |
| 48 | 21.5 | 7.1 | 0 | 2 | 0.905 | 0.5 | 0.10 | 0.12 | 0.46 | 0.00 | 0.00 | bal. | 0.39 | 0.01 | 0.08 | Present invention |
| 49 | 21.5 | 7.1 | 2 | 0 | 0.905 | 0.5 | 0.10 | 0.12 | 0.46 | 0.00 | 0.00 | bal. | 0.39 | 0.01 | 0.08 | Present invention |

TABLE 1-continued

| | Analysis results of R-T-B-based sintered magnet (% by mass) | | | | | | | | | | | | | | | |
|---|---|---|---|---|---|---|---|---|---|---|---|---|---|---|---|---|
| No. | Nd | Pr | Dy | Tb | B | Co | Al | Cu | Ga | Nb | Zr | Fe | O | N | C | |
| 50 | 21.5 | 7.2 | 2 | 0 | 0.944 | 0.5 | 0.10 | 0.13 | 0.10 | 0.00 | 0.00 | bal. | 0.40 | 0.01 | 0.08 | Comparative Example |
| 51 | 21.5 | 7.2 | 2 | 0 | 0.890 | 0.5 | 0.10 | 0.13 | 0.10 | 0.00 | 0.00 | bal. | 0.40 | 0.01 | 0.08 | Comparative Example |
| 52 | 20.7 | 6.7 | 4 | 0 | 0.940 | 0.5 | 0.10 | 0.12 | 0.10 | 0.00 | 0.00 | bal. | 0.40 | 0.01 | 0.08 | Comparative Example |
| 53 | 20.7 | 6.7 | 4 | 0 | 0.894 | 0.5 | 0.10 | 0.12 | 0.46 | 0.00 | 0.00 | bal. | 0.40 | 0.01 | 0.08 | Present invention |
| 54 | 20.7 | 6.7 | 3 | 0 | 0.905 | 0.5 | 0.10 | 0.08 | 0.44 | 0.00 | 0.00 | bal. | 0.10 | 0.05 | 0.10 | Present invention |
| 55 | 20.7 | 6.7 | 3 | 0 | 0.905 | 0.5 | 0.10 | 0.08 | 0.26 | 0 | 0 | bal. | 0.10 | 0.05 | 0.10 | Comparative Example |
| 56 | 30.3 | 0.0 | 0 | 0 | 0.910 | 0.5 | 0.05 | 0.08 | 0.45 | 0.00 | 0.00 | bal. | 0.10 | 0.05 | 0.10 | Present invention |
| 57 | 21.5 | 7.1 | 1 | 1 | 0.905 | 0.5 | 0.10 | 0.12 | 0.46 | 0.00 | 0.00 | bal. | 0.39 | 0.01 | 0.08 | Present invention |
| 58 | 22.1 | 7.2 | 0 | 0 | 0.850 | 0.5 | 0.10 | 0.13 | 0.54 | 0 | 0 | bal. | 0.07 | 0.01 | 0.06 | Present invention |
| 59 | 21.6 | 7.2 | 0 | 0 | 0.889 | 0.5 | 0.10 | 0.11 | 0.46 | 0 | 0 | bal. | 0.08 | 0.01 | 0.06 | Present invention |
| 60 | 21.6 | 7.1 | 0 | 0 | 0.910 | 0.5 | 0.10 | 0.11 | 0.43 | 0 | 0 | bal. | 0.08 | 0.01 | 0.07 | Present invention |
| 61 | 22.4 | 7.3 | 0 | 0 | 0.900 | 0.5 | 0.10 | 0.11 | 0.38 | 0 | 0.09 | bal. | 0.09 | 0.06 | 0.07 | Present invention |

TABLE 2

| No. | u | v | w | Region | $B_r$ (T) | $H_{cJ}$ (kA/m) | |
|---|---|---|---|---|---|---|---|
| 01 | 30.1 | 28.27 | 0.910 | 2 | 1.396 | 1502 | Present invention |
| 02 | 30.1 | 28.27 | 0.910 | 2 | 1.411 | 1454 | Present invention |
| 03 | 30.1 | 28.27 | 0.910 | 2 | 1.401 | 1500 | Present invention |
| 04 | 30.1 | 28.27 | 0.910 | 2 | 1.407 | 1484 | Present invention |
| 05 | 30.1 | 28.27 | 0.910 | 2 | 1.408 | 1473 | Present invention |
| 06 | 30.1 | 28.27 | 0.910 | 2 | 1.409 | 1480 | Present invention |
| 07 | 30.1 | 28.27 | 0.910 | 2 | 1.400 | 1498 | Present invention |
| 08 | 30.1 | 28.27 | 0.905 | 2 | 1.401 | 1280 | Comparative Example |
| 09 | 30.1 | 28.27 | 0.910 | 2 | 1.396 | 1502 | Present invention |
| 10 | 30.1 | 28.27 | 0.910 | 2 | 1.395 | 1510 | Present invention |
| 11 | 30.6 | 27.45 | 0.910 | 2 | 1.361 | 1500 | Present invention |
| 12 | 30.6 | 27.21 | 0.907 | 10 | 1.363 | 1213 | Comparative Example |
| 13 | 30.6 | 29.02 | 0.905 | 2 | 1.376 | 1460 | Present invention |
| 14 | 30.7 | 29.04 | 0.937 | 20 | 1.398 | 1275 | Comparative Example |
| 15 | 30.7 | 28.94 | 0.920 | 20 | 1.390 | 1279 | Comparative Example |
| 16 | 30.7 | 27.50 | 0.878 | 10 | 1.345 | 1145 | Comparative Example |
| 17 | 30.7 | 27.54 | 0.930 | 40 | 1.396 | 1212 | Comparative Example |
| 18 | 30.7 | 27.51 | 0.897 | 2 | 1.361 | 1350 | Present invention |
| 19 | 30.7 | 28.36 | 0.937 | 20 | 1.397 | 1249 | Comparative Example |
| 20 | 30.8 | 27.76 | 0.887 | 2 | 1.371 | 1340 | Present invention |
| 21 | 30.8 | 29.16 | 0.894 | 1 | 1.360 | 1525 | Present invention |
| 22 | 30.8 | 27.67 | 0.860 | 10 | 1.322 | 1010 | Comparative Example |
| 23 | 30.8 | 27.52 | 0.937 | 20 | 1.405 | 1180 | Comparative Example |
| 24 | 30.8 | 29.23 | 0.974 | 20 | 1.402 | 1200 | Comparative Example |
| 25 | 30.9 | 28.44 | 0.850 | 1 | 1.347 | 1380 | Present invention |
| 26 | 30.8 | 28.55 | 0.918 | 2 | 1.385 | 1490 | Present invention |
| 27 | 30.9 | 29.11 | 0.850 | 30 | 1.320 | 1600 | Comparative Example |
| 28 | 30.9 | 29.25 | 0.875 | 1 | 1.350 | 1548 | Present invention |

TABLE 2-continued

| No. | u | v | w | Region | $B_r$ (T) | $H_{cJ}$ (kA/m) | |
|---|---|---|---|---|---|---|---|
| 29 | 30.9 | 28.58 | 0.890 | 1 | 1.360 | 1470 | Present invention |
| 30 | 31.0 | 29.27 | 0.896 | 1 | 1.400 | 1272 | Comparative Example |
| 31 | 31.0 | 29.33 | 0.904 | 1 | 1.389 | 1428 | Present invention |
| 32 | 31.2 | 29.36 | 0.830 | 30 | 1.315 | 1550 | Comparative Example |
| 33 | 31.2 | 27.86 | 0.830 | 10 | 1.310 | 1510 | Comparative Example |
| 34 | 31.3 | 29.43 | 0.883 | 1 | 1.371 | 1580 | Present invention |
| 35 | 31.3 | 29.48 | 0.910 | 20 | 1.403 | 1250 | Comparative Example |
| 36 | 31.3 | 29.57 | 0.891 | 1 | 1.323 | 1540 | Comparative Example |
| 37 | 31.4 | 30.09 | 0.890 | 1 | 1.370 | 1573 | Present invention |
| 38 | 31.4 | 29.88 | 0.910 | 20 | 1.403 | 1270 | Comparative Example |
| 39 | 32.0 | 30.23 | 0.870 | 30 | 1.320 | 1460 | Comparative Example |
| 40 | 32.0 | 28.55 | 0.870 | 1 | 1.315 | 1420 | Comparative Example |
| 41 | 32.0 | 30.24 | 0.860 | 30 | 1.310 | 1480 | Comparative Example |
| 42 | 32.0 | 28.68 | 0.860 | 1 | 1.305 | 1440 | Comparative Example |
| 43 | 32.3 | 30.47 | 0.900 | 20 | 1.326 | 1358 | Comparative Example |
| 44 | 32.5 | 30.48 | 0.883 | 30 | 1.323 | 1455 | Comparative Example |
| 45 | 32.8 | 29.52 | 0.937 | 20 | 1.363 | 1261 | Comparative Example |
| 46 | 30.6 | 27.43 | 0.923 | 40 | 1.381 | 1280 | Comparative Example |
| 47 | 30.3 | 28.44 | 0.940 | 20 | 1.389 | 1492 | Comparative Example |
| 48 | 30.6 | 27.52 | 0.905 | 2 | 1.317 | 1960 | Present invention |
| 49 | 30.6 | 27.55 | 0.905 | 2 | 1.317 | 1800 | Present invention |
| 50 | 30.7 | 27.62 | 0.944 | 20 | 1.360 | 1490 | Comparative Example |
| 51 | 30.7 | 27.62 | 0.890 | 10 | 1.357 | 1272 | Comparative Example |
| 52 | 31.4 | 27.78 | 0.940 | 20 | 1.324 | 1730 | Comparative Example |
| 53 | 31.4 | 27.78 | 0.894 | 2 | 1.280 | 2051 | Present invention |
| 54 | 30.4 | 28.50 | 0.905 | 2 | 1.328 | 1978 | Present invention |
| 55 | 30.4 | 28.50 | 0.905 | 2 | 1.329 | 1760 | Comparative Example |
| 56 | 30.3 | 28.40 | 0.910 | 2 | 1.420 | 1400 | Present invention |

TABLE 2-continued

| No. | u | v | w | Region | $B_r$ (T) | $H_{cJ}$ (kA/m) | |
|---|---|---|---|---|---|---|---|
| 57 | 30.6 | 26.52 | 0.905 | 2 | 1.317 | 1880 | Present invention |
| 58 | 29.3 | 28.30 | 0.850 | 1 | 1.387 | 1410 | Present invention |
| 59 | 28.8 | 27.73 | 0.889 | 2 | 1.415 | 1400 | Present invention |
| 60 | 28.7 | 27.57 | 0.910 | 2 | 1.401 | 1525 | Present invention |
| 61 | 29.7 | 27.97 | 0.900 | 2 | 1.411 | 1440 | Present invention |

u in Table 2 is the value obtained by summing up the amounts of Nd, Pr, Dy and Tb in Table 1, and v is the value obtained by subtracting $6\alpha+10\beta+8\gamma$, where the amount of oxygen (% by mass) is $\alpha$, the amount of nitrogen (% by mass) is $\beta$, and the amount of carbon (% by mass) is $\gamma$ in Table 1, from u. Regarding w, the amount of B in Table 1 was transferred as it is. The region in Table 2 indicates the position of v and w in FIG. 1. The column in the table was filled with "1" when v and w exist in the region 1 in FIG. 1, while the column in the table was filled with "2" when v and w exist in the region 2 in FIG. 1. Furthermore, when v and w exist in the region except for the regions 1 and 2 in FIG. 1, the column in the table was filled with any one of 10, 20, 30, and 40 according to the position. For example, regarding No. 01, since v is 28.27% by mass and w is 0.910% by mass, and v and w exist in the region 2 in FIG. 1, the column in the table was filled with "2". Regarding No. 21, since v is 29.16% by mass and w is 0.894% by mass, and v and w exist in the region 1 in FIG. 1, the column in the table was filled with "1". Furthermore, regarding No. 47, since v is 28.44% by mass and w is 0.940% by mass, and v and w exist in the region 20 in FIG. 1, the column in the table was filled with "20".

Figure 4:
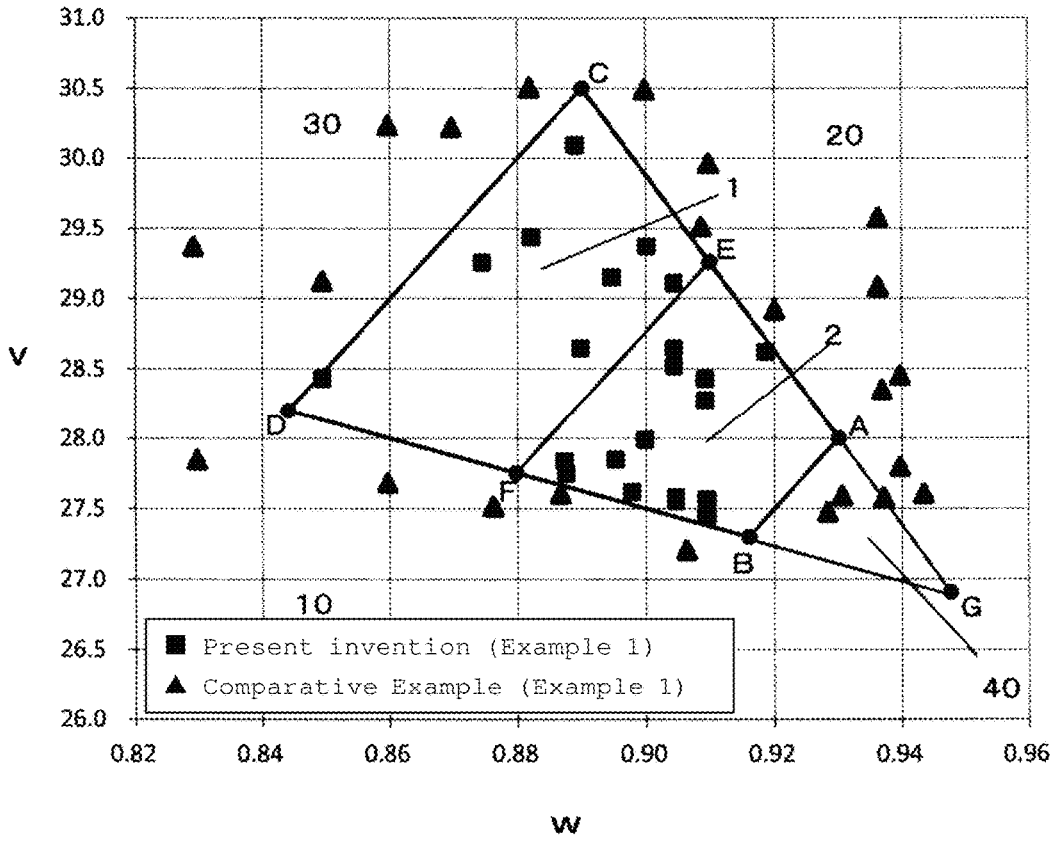
FIG. 4 is an explanatory graph showing the respective values of v and w of example samples and comparative example samples according to "<Example 1>" plotted in FIG. 1.

FIG. 4 is an explanatory graph showing the respective values of v and w of example samples and comparative example samples (namely, sample mentioned in Table 2) plotted in FIG. 1. From FIG. 4, it is possible to easily understand that example samples are within the range of the region 1 or 2, while comparative example samples deviate from the regions 1 and 2.

As mentioned above, in the present invention, if x is 0.40% by mass or more and 0.70% by mass or less, v and w are included in the following proportions:

$$50w-18.5 \le v \le 50w-14 \quad (6)$$

$$-12.5w+38.75 \le v \le -62.5w+86.125 \quad (7)$$

preferably $$50w-18.5 \le v \le 50w-16.25 \quad (11)$$

$$-12.5w+38.75 \le v \le -62.5w+86.125 \quad (7).$$

When included in the above proportion, the ranges of v and w correspond to the regions 1 and 2, or the region 2 in FIG. 1.

As shown in Table 2, when Dy and Tb are not included in the raw material alloy, any of example samples (example samples except for samples Nos. 48, 49, 53, 54 and 57), which exhibits the relationship between v and w located in the region of the present invention (regions 1 and 2 in FIG. 1), and also satisfies the following inequality expressions: $0.40 \le x(Ga) \le 0.70$, $0.07 \le y(Cu) \le 0.2$, $0.05 \le z(Al) \le 0.5$, and $0 \le q(M)(Nb \text{ and/or } Zr) \le 0.1$, has high magnetic properties of $B_r \ge 1.340$ T and $H_{cJ} \ge 1{,}300$ kA/m. Meanwhile, regarding Comparative Examples (for example, samples Nos. 12, 16, 22 and 35) in which the amounts of Ga, Cu and Al are within the range of the present invention but v and w deviate from the range of the present invention (region except for the region 1 or 2 in FIG. 1) and Comparative Examples (for example, samples Nos. 08, 30, 36, 40 and 42) in which v and w are within the range of the present invention (region 1 or 2 in FIG. 1) but the amounts of Ga and Cu deviate from the range of the present invention, high magnetic properties of $B_r \ge 1.340$ T and $H_{cJ} \ge 1{,}300$ kA/m are not obtained. Particularly, as is apparent from sample No. 07 which is Example, and sample No. 08 which is Comparative Example with the same composition except that the content of Ga is 0.17% by mass lower than that of sample No. 07, $H_{cJ}$ is significantly decreased when Ga deviates from the range of the present invention even if v and w are within the range of the present invention.

Regarding sample No. 08, the amount of Ga deviates from the range of Ga of the present invention $(-(62.5\,w+v-81.625)/15+0.5\times(Ga) \le -(62.5\,w+v-81.625)/15+0.8)$ if the amount of Ga is 0.20% by mass or more and less than 0.40% by mass, so that it is impossible to form the R-T-Ga phase minimally necessary for obtaining high magnetic properties, leading to significant reduction in $H_{cJ}$.

When Dy or Tb are included in the raw material alloy, $B_r$ is decreased and $H_{cJ}$ is improved according to the content of Dy or Tb. In this case, $B_r$ decreases by about 0.024T if 1% by mass of Dy or Tb is included. $H_{cJ}$ increases by about 160 kA/m if 1% by mass of Dy is included, and increases by about 240 kA/m if 1% by mass of Tb is included.

Therefore, in the present invention, when Dy and Tb are not included in the raw material alloy as mentioned above, because of having magnetic properties of $B_r \ge 1.340$ T and $H_{cJ} \ge 1{,}300$ kA/m, magnetic properties of $B_r(T) \ge 1.340-0.024[Dy]-0.024[Tb]$ and $H_{cJ}(kA/m) \ge 1{,}300+160[Dy]+240[Tb]$ are obtained according to the content of Dy or Tb. [Dy] or [Tb] represents each content (% by mass) of Dy or Tb.

As shown in Table 2, any of Examples (samples Nos. 48, 49, 53, 54 and 57) in which Dy and Tb are included in the raw material alloy has high magnetic properties of $B_r(T) \ge 1.340-0.024[Dy]-0.024[Tb]$ and $H_{cJ}(kA/m) \ge 1{,}300+160[Dy]+240[Tb]$. Meanwhile, any of Comparative Examples (samples Nos. 47, 50, 51, 52 and 55) does not have high magnetic properties of $B_r(T) \ge 1.340-0.024[Dy]-0.024[Tb]$ and $H_{cJ}(kA/m) \ge 1{,}300+160[Dy]+240[Tb]$. Particularly, as is apparent from sample No. 54 which is Example, and sample No. 55 which is Comparative Example with the same composition except that the content of Ga is 0.18% by mass lower than that of sample No. 54, $H_{cJ}$ is significantly decreased when Ga deviates from the range of the present invention even if v and w are within the range of the present invention. Regarding sample No. 55, the amount of Ga deviates from the range of Ga of the present invention $(-(62.5w+v-81.625)/15+0.5 \le x(Ga) \le -(62.5w+v-81.625)/15+0.8)$ when the amount of Ga is 0.20% by mass or more and less than 0.40% by mass, so that it is impossible to form the R-T-Ga phase minimally necessary for obtaining high magnetic properties, leading to significant reduction in $H_{cJ}$.

Furthermore, as shown in Table 2, in the present invention, it is possible to obtain higher $B_r$ ($B_r \ge 1.360$ T when Dy or Tb are not included in raw material alloy, $B_r \ge 1.360$ T$-0.024[Dy]-0.024[Tb]$ when Dy and Tb is included in raw material alloy) in the region 2 (region 2 in FIG. 1) as compared with the region 1 (region 1 in FIG. 1). [Dy] or [Tb] represents each content (% by mass) of Dy or Tb.

Example 2

Nd metal, Pr metal, Dy metal, Tb metal, ferroboron alloy, electrolytic Co, Al metal, Cu metal, Ga metal, ferro-niobium alloy, ferro-zirconium alloy and electrolytic iron (any of metals has a purity of 99% by mass or more) were mixed so as to obtain a given composition, and then a finely pulverized powder (alloy powder) having a grain size $D_{50}$ of 4 μm was obtained in the same manner as in Example 1. By mixing the nitrogen gas with atmospheric air during pulverization, the oxygen concentration in a nitrogen gas during pulverization was adjusted. When mixing with no atmospheric air, the oxygen concentration in the nitrogen gas during pulverization is 50 ppm or less and the oxygen concentration in the nitrogen gas was increased to 1,500 ppm at a maximum by mixing with atmospheric air to produce finely pulverized powders each having a different oxygen amount. The grain size $D_{50}$ is a median size on a volume basis obtained by a laser diffraction method using an air flow dispersion method. In Table 3, O (amount of oxygen), N (amount of nitrogen) and C (amount of carbon) were measured in the same manner as in Example 1.

To the finely pulverized powder, zinc stearate was added as a lubricant in the proportion of 0.05% by mass based on 100% by mass of the coarsely pulverized powder, followed by mixing to obtain a compact in the same manner as in Example 1. Furthermore, the compact was sintered and subjected to a heat treatment in the same manner as in Example 1. The sintered magnet was subjected to machining after the heat treatment, and then $B_r$ and $H_{cJ}$ of each sample were measured in the same manner as in Example 1. The measurement results are shown in Table 4.

TABLE 4-continued

| No. | u | v | w | Region | $B_r$ (T) | $H_{cJ}$ (kA/m) | |
|---|---|---|---|---|---|---|---|
| 76 | 30.2 | 27.89 | 0.924 | 4 | 1.430 | 1422 | Present invention |
| 77 | 30.2 | 28.57 | 0.890 | 3 | 1.378 | 1473 | Present invention |
| 78 | 30.2 | 28.27 | 0.910 | 4 | 1.401 | 1505 | Present invention |
| 79 | 30.2 | 28.27 | 0.910 | 4 | 1.416 | 1457 | Present invention |
| 80 | 30.2 | 28.27 | 0.910 | 4 | 1.400 | 1513 | Present invention |
| 81 | 30.4 | 28.50 | 0.905 | 3 | 1.333 | 1981 | Present invention |
| 82 | 30.2 | 28.27 | 0.910 | 4 | 1.406 | 1503 | Present invention |
| 83 | 30.2 | 28.27 | 0.910 | 4 | 1.412 | 1487 | Present invention |
| 84 | 30.2 | 28.27 | 0.910 | 4 | 1.413 | 1476 | Present invention |
| 85 | 30.2 | 28.27 | 0.910 | 4 | 1.414 | 1483 | Present invention |
| 86 | 30.3 | 28.40 | 0.910 | 4 | 1.425 | 1403 | Present invention |
| 87 | 31.4 | 30.09 | 0.890 | x | 1.373 | 1568 | Comparative Example |
| 88 | 30.9 | 29.25 | 0.875 | x | 1.359 | 1539 | Comparative Example |
| 89 | 30.1 | 28.27 | 0.905 | 4 | 1.401 | 1280 | Comparative Example |

TABLE 3

| | Analysis results of R-T-B-based sintered magnet (% by mass) | | | | | | | | | | | | | | | |
|---|---|---|---|---|---|---|---|---|---|---|---|---|---|---|---|---|
| No. | Nd | Pr | Dy | Tb | B | Co | Al | Cu | Ga | Nb | Zr | Fe | O | N | C | |
| 70 | 23.4 | 7.7 | 0 | 0 | 0.904 | 0.5 | 0.10 | 0.16 | 0.27 | 0.00 | 0.00 | bal. | 0.07 | 0.05 | 0.11 | Present invention |
| 71 | 23.0 | 7.6 | 0 | 0 | 0.910 | 0.5 | 0.10 | 0.12 | 0.27 | 0.00 | 0.00 | bal. | 0.08 | 0.04 | 0.09 | Present invention |
| 72 | 22.7 | 7.4 | 0 | 0 | 0.918 | 0.5 | 0.10 | 0.13 | 0.27 | 0.00 | 0.00 | bal. | 0.13 | 0.03 | 0.08 | Present invention |
| 73 | 22.7 | 7.4 | 0 | 0 | 0.880 | 0.9 | 0.10 | 0.15 | 0.39 | 0.00 | 0.00 | bal. | 0.11 | 0.05 | 0.09 | Present invention |
| 74 | 22.7 | 7.4 | 0 | 0 | 0.892 | 0.9 | 0.10 | 0.15 | 0.39 | 0.00 | 0.00 | bal. | 0.12 | 0.05 | 0.09 | Present invention |
| 75 | 22.7 | 7.4 | 0 | 0 | 0.910 | 0.9 | 0.10 | 0.15 | 0.31 | 0.00 | 0.00 | bal. | 0.15 | 0.05 | 0.11 | Present invention |
| 76 | 22.7 | 7.4 | 0 | 0 | 0.924 | 0.9 | 0.10 | 0.15 | 0.28 | 0.00 | 0.00 | bal. | 0.15 | 0.05 | 0.11 | Present invention |
| 77 | 22.7 | 7.4 | 0 | 0 | 0.890 | 0.5 | 0.10 | 0.15 | 0.35 | 0.00 | 0.00 | bal. | 0.10 | 0.04 | 0.08 | Present invention |
| 78 | 22.7 | 7.4 | 0 | 0 | 0.910 | 0.5 | 0.10 | 0.08 | 0.32 | 0.00 | 0.00 | bal. | 0.10 | 0.05 | 0.10 | Present invention |
| 79 | 22.7 | 7.4 | 0 | 0 | 0.910 | 0.5 | 0.05 | 0.08 | 0.32 | 0.00 | 0.00 | bal. | 0.10 | 0.05 | 0.10 | Present invention |
| 80 | 22.7 | 7.4 | 0 | 0 | 0.910 | 0.0 | 0.10 | 0.08 | 0.32 | 0.00 | 0.00 | bal. | 0.10 | 0.05 | 0.10 | Present invention |
| 81 | 20.7 | 6.7 | 3.0 | 0 | 0.905 | 0.5 | 0.10 | 0.08 | 0.34 | 0.00 | 0.00 | bal. | 0.10 | 0.05 | 0.10 | Present invention |
| 82 | 22.7 | 7.4 | 0 | 0 | 0.910 | 2.0 | 0.10 | 0.08 | 0.32 | 0.00 | 0.00 | bal. | 0.10 | 0.05 | 0.10 | Present invention |
| 83 | 22.7 | 7.4 | 0 | 0 | 0.910 | 0.5 | 0.05 | 0.08 | 0.32 | 0.10 | 0.00 | bal. | 0.10 | 0.05 | 0.10 | Present invention |
| 84 | 22.7 | 7.4 | 0 | 0 | 0.910 | 0.5 | 0.05 | 0.08 | 0.33 | 0.00 | 0.10 | bal. | 0.10 | 0.05 | 0.10 | Present invention |
| 85 | 22.7 | 7.4 | 0 | 0 | 0.910 | 0.5 | 0.05 | 0.08 | 0.33 | 0.03 | 0.05 | bal. | 0.10 | 0.05 | 0.10 | Present invention |
| 86 | 30.3 | 0.0 | 0 | 0 | 0.910 | 0.5 | 0.05 | 0.08 | 0.33 | 0.00 | 0.00 | bal. | 0.10 | 0.05 | 0.10 | Present invention |
| 87 | 23.6 | 7.8 | 0 | 0 | 0.890 | 0.5 | 0.10 | 0.16 | 0.32 | 0.00 | 0.00 | bal. | 0.07 | 0.03 | 0.07 | Comparative Example |
| 88 | 23.2 | 7.7 | 0 | 0 | 0.875 | 0.5 | 0.10 | 0.20 | 0.38 | 0.00 | 0.00 | bal. | 0.08 | 0.04 | 0.09 | Comparative Example |
| 89 | 22.7 | 7.4 | 0 | 0 | 0.905 | 0.5 | 0.10 | 0.08 | 0.26 | 0.00 | 0.00 | bal. | 0.10 | 0.05 | 0.10 | Comparative Example |

TABLE 4

| No. | u | v | w | Region | $B_r$ (T) | $H_{cJ}$ (kA/m) | |
|---|---|---|---|---|---|---|---|
| 70 | 31.1 | 29.33 | 0.904 | 3 | 1.394 | 1431 | Present invention |
| 71 | 30.6 | 29.02 | 0.910 | 3 | 1.381 | 1463 | Present invention |
| 72 | 30.2 | 28.49 | 0.918 | 4 | 1.390 | 1493 | Present invention |
| 73 | 30.2 | 28.29 | 0.880 | 3 | 1.373 | 1582 | Present invention |
| 74 | 30.2 | 28.23 | 0.892 | 3 | 1.377 | 1527 | Present invention |
| 75 | 30.1 | 27.82 | 0.910 | 4 | 1.421 | 1438 | Present invention |

u in Table 4 is the value obtained by summing up the amounts (% by mass) of Nd, Pr, Dy and Tb in Table 2, and v is the value obtained by subtracting $6\alpha+10\beta+8\gamma$, where the amount of oxygen (% by mass) is α, the amount of nitrogen (% by mass) is β, and the amount of carbon (% by mass) is γ in Table 3, from u. Regarding w, the amount of B in Table 3 was transferred as it is. The region in Table 4 indicates the position of v and w in FIG. 2. The column in the table was filled with "3" when v and w exist in the region 3 in FIG. 2, while the column in the table was filled with "4" when v and w exist in the region 4 in FIG. 2. Furthermore, when v and w exist in the region except for the regions 3 and 4 in FIG. 2, the column in the table was filled with the mark "x".

As shown in Table 4, when Dy and Tb are not included in the raw material alloy, any of Examples (Examples except for sample No. 81), which exhibits the relationship between v and w located in the region of the present invention (regions 3 and 4 in FIG. 2), and also satisfies the following inequality expressions: $-(62.5w+v-81.625)/15+0.5 \leq x \leq -(62.5w+v-81.625)/15+0.8$, $0.07 \leq y(Cu) \leq 0.2$, $0.05 \leq z(Al) \leq 0.5$, and $0 \leq q(Nb \text{ and/or } Zr) \leq 0.1$, exhibits $B_r \geq 1.377$ T and $H_{cJ} \geq 1{,}403$ kA/m, and also has high magnetic properties, which are identical to or higher than those of Example 1, regardless of the amount of Ga smaller than that of example sample of Example 1 (x(Ga) of 0.40% by mass or more). Meanwhile, regarding comparative example samples Nos. 87 and 88 in which the amounts of Ga, Cu and Al are within the range of the present invention but v and w deviate from the range of the present invention (region except for the region 3 or 4 in FIG. 2) and comparative example sample 89 in which v and w are within the range of the present invention (region 3 or 4 in FIG. 2) but the amount of Ga deviates from the range of the present invention, high magnetic properties of $B_r \geq 1.377$ T and $H_{cJ} \geq 1{,}403$ kA/m are not obtained.

As shown in Table 4, when Dy and Tb are not included in the raw material alloy, any of Examples (Examples except for sample No. 81), which exhibits the relationship between v and w located in the region of the present invention (regions 3 and 4 in FIG. 2) if $0.20 \leq x(Ga) < 0.40$, and also satisfies the following inequality expressions: $-(62.5w+v-81.625)/15+0.5 \leq x \leq -(62.5w+v-81.625)/15+0.8$, $0.07 \leq y(Cu) \leq 0.2$, $0.05 \leq z(Al) \leq 0.5$, and $0 \leq q(Nb \text{ and/or } Zr) \leq 0.1$, exhibits $B_r \geq 1.377$ T and $H_{cJ} \geq 1{,}403$ kA/m, and also has high magnetic properties, which are identical to or higher than those of Example 1, regardless of the amount of Ga smaller than that of example sample of Example 1 (x(Ga) of 0.40% by mass or more). Meanwhile, regarding comparative example samples Nos. 87 and 88 in which the amounts of Ga, Cu, and Al are within the range of the present invention but v and w deviate from the range of the present invention (region except for the region 3 or 4 in FIG. 2) and comparative example sample 89 in which v and w are within the range of the present invention (region 3 or 4 in FIG. 2) but the amount of Ga deviates from the range of the present invention, high magnetic properties of $B_r \geq 1.377$ T and $H_{cJ} \geq 1{,}403$ kA/m are not obtained.

Example 3

Figure 5:
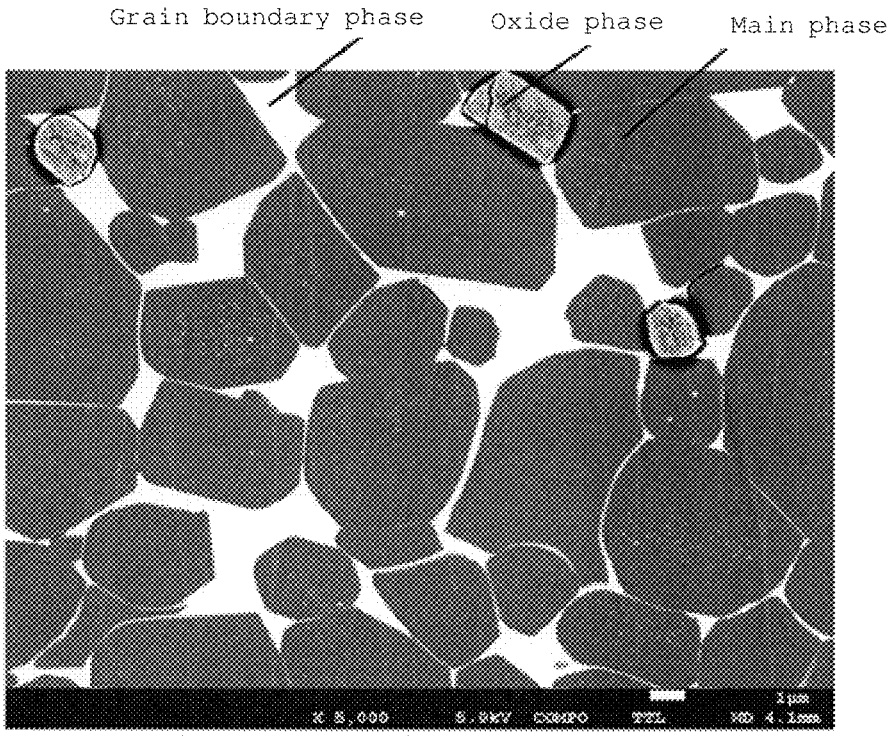
FIG. 5 is a photograph of a BSE image obtained by FE-SEM observation of a cross section of an R-T-B based sintered magnet.
Figure 6:
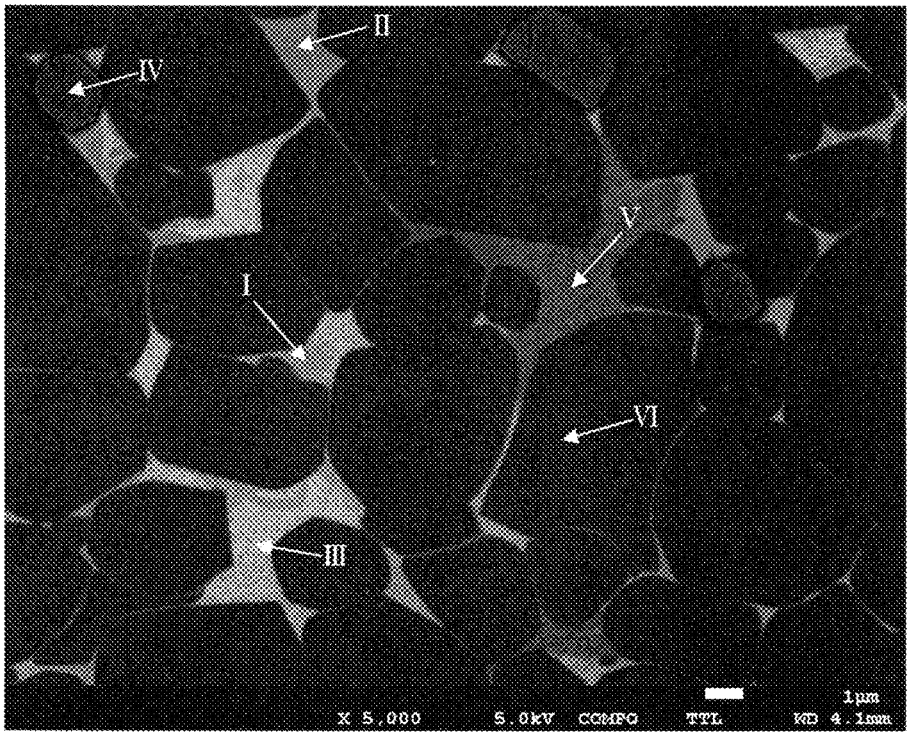
FIG. 6 is a photograph of a BSE image obtained by FE-SEM observation of a cross section of an R-T-B based sintered magnet.

The results of structure observation of an R-T-B based sintered magnet are shown. FIG. 5 shows a BSE image obtained by FE-SEM (field emission-type electron microscope) observation of a cross section obtained by polishing (2 mm each) an entire surface of an R-T-B based sintered magnet of sample No. 34 of Example 1, and cutting from the center. In FIG. 5 (high contrast image), a white region corresponds to a grain boundary phase, a light gray region corresponds to an oxide phase, and a deep gray region corresponds to a main phase. FIG. 6 (grain boundary phase-weighted contrast image) is a photograph whose contrast was adjusted to classify the grain boundary phase in detail. In FIG. 6, a main phase and an oxide phase are indicated by black color, an R-T-Ga phase is indicated by dark gray color, an R—Ga phase is indicated by light gray color, and an R-rich phase is indicated by white color. Each position corresponding to each phase in FIG. 6 (R—Ga phase: I, II, R-rich phase: III, oxide phase: IV, R-T-Ga phase: V, main phase: VI) was cut off and then analyzed by TEM-EDX (energy dispersive X-ray spectroscopy), thus confirming that each phase is as mentioned above. The analysis results are shown in Table 5.

TABLE 5

(% by mass)

| No. | Phase | Fe | Nd | Pr | R(Nd + Pr) | Co | Al | Cu | Ga | O |
|---|---|---|---|---|---|---|---|---|---|---|
| I | R-Ga phase | 6.9 | 58.5 | 23.0 | 81.5 | 0.5 | 1.1 | 4.1 | 5.2 | 0.7 |
| II | R-Ga phase | 4.4 | 56.2 | 25.8 | 82.0 | 1.3 | 0.7 | 3.2 | 7.6 | 0.8 |
| III | R-rich phase | 0.8 | 60.7 | 35.7 | 96.4 | 0.1 | 0.9 | 0.3 | 0.8 | 0.7 |
| IV | Oxide phase | 1.6 | 70.9 | 23.0 | 93.9 | 0.2 | 0.9 | 0.3 | 0.7 | 2.4 |
| V | R-T-Ga phase | 30.8 | 42.5 | 19.4 | 61.9 | 0.8 | 1.2 | 0.4 | 3.8 | 1.1 |
| VI | Main phase | 57.7 | 29.3 | 9.2 | 38.5 | 0.9 | 0.9 | 0.4 | 0.7 | 0.9 |

As shown in Table 5, it is apparent that Nos. I and II correspond to an R—Ga phase since R: 70% by mass or more and 95% by mass or less, Ga: 5% by mass or more and 30% by mass or less, and Fe: 20% by mass or less. It is also apparent that No. V corresponds to an R-T-Ga phase since R: 15% by mass or more 65% by mass or less, Fe: 20% by mass or more and 80% by mass or less, and Ga: 2% by mass or more and 20% by mass or less. It is also apparent that No. III corresponds to an R-rich phase because of large amount of R, and No. IV corresponds to an oxide phase because of a large amount of oxygen (O).

Using an image processing software, an area ratio of the R-T-Ga phase in the cross section image was determined. First, an area ratio A of a gray region corresponding to an oxide phase (proportion of the number of pixels of the gray part relative to the total number of pixels) in FIG. 5 (high contrast image) was calculated. Then, an area ratio B of a black part corresponding to a main phase+(plus) an oxide phase, an area ratio C of a dark grey part corresponding to an R-T-Ga phase, an area ratio D of a light grey part corresponding to an R—Ga phase, and an area ratio E of a white part corresponding to an R-rich phase in FIG. 6 (grain boundary phase-weighted contrast image) were calculated, respectively. Here, the area ratio of the R-T-Ga phase was defined as "100×C/(B+C+D+E−A)". The area ratio of the R-T-Ga phase was also determined in samples Nos. 15 and 42 of Example 1, and samples Nos. 70 and 75 of Example 2. The results are shown in Table 6.

TABLE 6

| No. | $B_r$ (T) | $H_{cJ}$ (kA/m) | Area ratio of R-T-Ga phase (%) | |
|---|---|---|---|---|
| 15 | 1.390 | 1279 | 0.8 | Comparative Example |
| 70 | 1.394 | 1431 | 1.5 | Present invention |
| 75 | 1.421 | 1438 | 4.1 | Present invention |
| 34 | 1.371 | 1580 | 7.0 | Present invention |
| 42 | 1.305 | 1440 | 8.9 | Comparative Example |

As shown in Table 6, regarding samples Nos. 70, 75 and 34 which are Examples, the area ratio of the R-T-Ga phase is within a range of 1.5% to 7.0%. Meanwhile, regarding samples Nos. 15 and 42 which are Comparative Examples, the area ratio deviates from the above range. It is considered that high $H_{cJ}$ could not obtained since the area ratio of the R-T-Ga phase in sample No. 15 is too small, and that the existence ratio of the main phase decreased, thus failing to obtain high $B_r$ since the area ratio of the R-T-Ga phase in sample No. 42 is too large.

Example 4

Using Nd metal, Pr metal, ferroboron alloy, electrolytic Co, Al metal, Cu metal, Ga metal, ferro-niobium alloy, ferro-zirconium alloy and electrolytic iron (any of metals has a purity of 99% by mass or more), each additional alloy powder and each main alloy powder were mixed so as to obtain a composition shown in Table 7, and then these raw materials were melted and subjected to casting by a strip casting method to obtain a flaky alloy having a thickness of 0.2 to 0.4 mm. The flaky alloy thus obtained was subjected to hydrogen grinding in a hydrogen atmosphere under an increased pressure and then subjected to a dehydrogenation treatment of heating to 550° C. in vacuum and cooling to obtain a coarsely pulverized powder. The coarsely pulverized powder thus obtained of the additional alloy and the coarsely pulverized powder thus obtained of the main alloy were loaded in a given mixing amount in a V-type mixer, followed by mixing to obtain a mixed alloy powder. To the mixed alloy powder thus obtained, zinc stearate was added as a lubricant in the proportion of 0.04% by mass based on 100% by mass of the coarsely pulverized powder, followed by mixing. Using an air flow-type pulverizer (jet milling machine), the mixture was subjected to dry pulverization in a nitrogen gas flow to obtain a mixed alloy powder which is a finely pulverized powder having a grain size $D_{50}$ of 4 μm. By mixing the nitrogen gas with atmospheric air during pulverization, the oxygen concentration in a nitrogen gas during pulverization was adjusted. When mixing with no atmospheric air, the oxygen concentration in the nitrogen gas during pulverization is 50 ppm or less and the oxygen concentration in the nitrogen gas was increased to 1,600 ppm at a maximum by mixing with atmospheric air to produce finely pulverized powders each having a different oxygen amount. The grain size $D_{50}$ is a median size on a volume basis obtained by a laser diffraction method using an air flow dispersion method. N (amount of nitrogen) and C (amount of carbon) in Table 8, O (amount of oxygen), were measured in the same manner as in Example 1.

To a finely pulverized powder (mixed alloy powder) obtained by mixing an additional alloy powder with a main alloy powder, zinc stearate was added as a lubricant in the proportion of 0.05% by mass based on 100% by mass of the coarsely pulverized powder, followed by mixing to obtain a compact in the same manner as in Example 1. Furthermore, the compact was sintered and subjected to a heat treatment in the same manner as in Example 1. The sintered magnet was subjected to machining after the heat treatment, and then $B_r$ and $H_{cJ}$ of each sample were measured in the same manner as in Example 1. The measurement results are shown in Table 9.

Each composition of the thus obtained additional alloy powder and main alloy powder to be used in the production method of the present invention is shown in Table 7. Furthermore, each composition of the R-T-B based sintered magnet obtained by mixing the additional alloy powder and the main alloy powder in Table 7 is shown in Table 8. Sample No. 100 in Table 8 is an R-T-B based sintered magnet produced using a mixed alloy powder obtained by mixing an A alloy powder (additional alloy powder) and an A-1 alloy powder (main alloy powder) in Table 7, and a mixing amount of the additional alloy powder in the mixed alloy powder accounts for 4% by mass of 100% by mass of the mixed alloy powder. Furthermore, sample No. 101 is an R-T-B based sintered magnet produced using a mixed alloy powder obtained by mixing an A alloy powder (additional alloy powder) with an A-2 alloy powder (main alloy powder) in Table 7, and a mixing amount of the additional alloy powder in the mixed alloy powder accounts for 4% by mass of 100% by mass of the mixed alloy powder. Samples Nos. 102 to 140 were also produced by combination of a mixed alloy powder and a mixing amount of an additional alloy powder shown in Table 8 in the same manner. Any of the composition of the additional alloy powder and the main alloy powder shown in Table 7, and the mixing amount of the additional alloy powder shown in Table 8 is within the range of preferred aspects (aspects 3 and 4) of the present invention. Furthermore, any of the composition of the R-T-B based sintered magnet shown in Table 8 is within the range of the composition of the R-T-B based sintered magnet of the present invention.

TABLE 7

| Alloy | | Analysis results of alloy powder (% by mass) | | | | | | | | | | |
|---|---|---|---|---|---|---|---|---|---|---|---|---|
| powder | Type of alloy | Nd | Pr | Dy | B | Co | Al | Cu | Ga | Nb | Zr | Fe |
| A | Additional alloy powder | 42.5 | 13.9 | 0 | 0.500 | 0.0 | 0.10 | 0.15 | 6.79 | 0 | 0 | bal. |
| A-1 | Main alloy powder | 22.6 | 7.4 | 0 | 0.920 | 0.5 | 0.10 | 0.16 | 0.23 | 0 | 0 | bal. |
| A-2 | Main alloy powder | 22.4 | 7.5 | 0 | 0.889 | 0.5 | 0.10 | 0.20 | 0.29 | 0 | 0 | bal. |
| A-3 | Main alloy powder | 22.8 | 7.5 | 0 | 0.905 | 0.5 | 0.10 | 0.16 | 0.24 | 0 | 0 | bal. |
| A-4 | Main alloy powder | 21.9 | 7.2 | 0 | 0.926 | 0.5 | 0.10 | 0.08 | 0.21 | 0 | 0 | bal. |
| A-5 | Main alloy powder | 21.9 | 7.2 | 0 | 0.926 | 0.5 | 0.05 | 0.08 | 0.21 | 0 | 0 | bal. |
| A-6 | Main alloy powder | 21.9 | 7.2 | 0 | 0.926 | 0.5 | 0.10 | 0.08 | 0.17 | 0 | 0 | bal. |
| A-7 | Main alloy powder | 21.9 | 7.2 | 0 | 0.926 | 2.1 | 0.10 | 0.08 | 0.21 | 0 | 0 | bal. |
| A-8 | Main alloy powder | 21.9 | 7.2 | 0 | 0.926 | 0.5 | 0.05 | 0.08 | 0.15 | 0.10 | 0 | bal. |
| A-9 | Main alloy powder | 21.9 | 7.2 | 0 | 0.926 | 0.5 | 0.05 | 0.08 | 0.14 | 0 | 0.10 | bal. |
| A-10 | Main alloy powder | 21.9 | 7.2 | 0 | 0.926 | 0.5 | 0.05 | 0.08 | 0.13 | 0.03 | 0.05 | bal. |
| A-11 | Main alloy powder | 21.9 | 7.2 | 0 | 0.934 | 0.5 | 0.10 | 0.13 | 0.00 | 0 | 0 | bal. |
| A-12 | Main alloy powder | 21.9 | 7.2 | 0 | 0.895 | 0.9 | 0.10 | 0.15 | 0.13 | 0 | 0 | bal. |
| A-13 | Main alloy powder | 21.9 | 7.2 | 0 | 0.907 | 0.9 | 0.10 | 0.15 | 0.12 | 0 | 0 | bal. |
| A-14 | Main alloy powder | 21.9 | 7.1 | 0 | 0.926 | 0.9 | 0.10 | 0.15 | 0.04 | 0 | 0 | bal. |
| A-15 | Main alloy powder | 21.9 | 7.2 | 0 | 0.941 | 0.9 | 0.10 | 0.15 | 0.01 | 0 | 0 | bal. |
| A-16 | Main alloy powder | 21.9 | 7.2 | 0 | 0.905 | 0.5 | 0.10 | 0.15 | 0.08 | 0 | 0 | bal. |
| A-17 | Main alloy powder | 19.8 | 6.4 | 3.1 | 0.921 | 0.5 | 0.10 | 0.08 | 0.07 | 0 | 0 | bal. |
| A-18 | Main alloy powder | 21.3 | 6.9 | 0 | 0.864 | 0.5 | 0.10 | 0.13 | 0.28 | 0 | 0 | bal. |
| A-19 | Main alloy powder | 20.7 | 6.9 | 0 | 0.904 | 0.5 | 0.10 | 0.11 | 0.20 | 0 | 0 | bal. |
| A-20 | Main alloy powder | 20.7 | 6.8 | 0 | 0.926 | 0.5 | 0.10 | 0.11 | 0.17 | 0 | 0 | bal. |
| A-21 | Main alloy powder | 21.5 | 7.0 | 0 | 0.916 | 0.5 | 0.10 | 0.11 | 0.11 | 0 | 0.09 | bal. |
| B | Additional alloy powder | 49.2 | 16.1 | 0 | 0.350 | 1.5 | 3.80 | 0.40 | 11.30 | 0 | 0 | bal. |
| B-1 | Main alloy powder | 23.3 | 7.7 | 0 | 0.894 | 0.5 | 0.06 | 0.15 | 0.39 | 0 | 0 | bal. |

TABLE 7-continued

| Alloy powder | Type of alloy | Analysis results of alloy powder (% by mass) Nd | Pr | Dy | B | Co | Al | Cu | Ga | Nb | Zr | Fe |
|---|---|---|---|---|---|---|---|---|---|---|---|---|
| B-2 | Main alloy powder | 22.5 | 7.3 | 0 | 0.915 | 0.5 | 0.01 | 0.07 | 0.29 | 0.03 | 0.05 | bal. |
| B-3 | Main alloy powder | 22.5 | 7.3 | 0 | 0.923 | 0.5 | 0.06 | 0.12 | 0.16 | 0 | 0 | bal. |
| B-4 | Main alloy powder | 22.5 | 7.3 | 0 | 0.884 | 0.9 | 0.06 | 0.14 | 0.28 | 0 | 0 | bal. |
| B-5 | Main alloy powder | 22.4 | 7.3 | 0 | 0.915 | 0.9 | 0.06 | 0.14 | 0.20 | 0 | 0 | bal. |
| B-6 | Main alloy powder | 22.5 | 7.3 | 0 | 0.894 | 0.5 | 0.06 | 0.14 | 0.24 | 0 | 0 | bal. |
| B-7 | Main alloy powder | 20.4 | 6.6 | 3.0 | 0.910 | 0.5 | 0.06 | 0.07 | 0.23 | 0 | 0 | bal. |
| C | Additional alloy powder | 24.0 | 8.0 | 0 | 0.900 | 2.0 | 0.10 | 0.10 | 2.00 | 0 | 0 | bal. |
| C-1 | Main alloy powder | 23.6 | 7.7 | 0 | 0.888 | 0.3 | 0.10 | 0.17 | 0.33 | 0 | 0 | bal. |
| C-2 | Main alloy powder | 22.6 | 7.4 | 0 | 0.910 | 0.3 | 0.04 | 0.08 | 0.22 | 0.03 | 0.06 | bal. |
| C-3 | Main alloy powder | 22.6 | 7.4 | 0 | 0.919 | 0.3 | 0.10 | 0.13 | 0.08 | 0 | 0 | bal. |
| C-4 | Main alloy powder | 22.6 | 7.4 | 0 | 0.877 | 0.8 | 0.10 | 0.16 | 0.22 | 0 | 0 | bal. |
| C-5 | Main alloy powder | 22.6 | 7.3 | 0 | 0.910 | 0.8 | 0.10 | 0.16 | 0.12 | 0 | 0 | bal. |
| C-6 | Main alloy powder | 22.6 | 7.4 | 0 | 0.887 | 0.3 | 0.10 | 0.16 | 0.17 | 0 | 0 | bal. |
| C-7 | Main alloy powder | 20.3 | 6.6 | 3.3 | 0.904 | 0.3 | 0.10 | 0.08 | 0.16 | 0 | 0 | bal. |
| D | Additional alloy powder | 33.0 | 11.0 | 0 | 1.455 | 4.5 | 0.10 | 0.10 | 2.00 | 0.30 | 0.50 | bal. |
| D-1 | Main alloy powder | 21.6 | 7.0 | 0 | 0.848 | 0.04 | 0.04 | 0.08 | 0.22 | 0 | 0 | bal. |
| E | Additional alloy powder | 24.0 | 8.0 | 0 | 0.915 | 0.9 | 0.10 | 0.15 | 0.70 | 0 | 0 | bal. |
| E-1 | Main alloy powder | 22.2 | 7.2 | 0 | 0.906 | 0.3 | 0.03 | 0.05 | 0.27 | 0.04 | 0.07 | bal. |
| E-2 | Main alloy powder | 22.2 | 7.2 | 0 | 0.918 | 0.3 | 0.10 | 0.12 | 0.09 | 0 | 0 | bal. |
| E-3 | Main alloy powder | 22.2 | 7.2 | 0 | 0.864 | 0.9 | 0.10 | 0.15 | 0.26 | 0 | 0 | bal. |
| E-4 | Main alloy powder | 22.1 | 7.1 | 0 | 0.906 | 0.9 | 0.10 | 0.15 | 0.14 | 0 | 0 | bal. |
| E-5 | Main alloy powder | 22.2 | 7.2 | 0 | 0.877 | 0.3 | 0.10 | 0.15 | 0.20 | 0 | 0 | bal. |

TABLE 8

| No. | Analysis results of R-T-B-based sintered magnet (% by mass) Nd | Pr | Dy | B | Co | Al | Cu | Ga | Nb | Zr | Fe | O | N | C | v | Mixed alloy powder | Mixing amount of additional alloy powder |
|---|---|---|---|---|---|---|---|---|---|---|---|---|---|---|---|---|---|
| 100 | 23.4 | 7.7 | 0 | 0.903 | 0.5 | 0.10 | 0.16 | 0.49 | 0 | 0 | bal. | 0.08 | 0.05 | 0.10 | 29.29 | A + A-1 | 4% |
| 101 | 23.2 | 7.7 | 0 | 0.874 | 0.5 | 0.10 | 0.20 | 0.55 | 0 | 0 | bal. | 0.09 | 0.05 | 0.09 | 29.21 | A + A-2 | 4% |
| 102 | 23.6 | 7.8 | 0 | 0.889 | 0.5 | 0.10 | 0.16 | 0.50 | 0 | 0 | bal. | 0.08 | 0.04 | 0.07 | 30.05 | A + A-3 | 4% |
| 103 | 22.7 | 7.4 | 0 | 0.909 | 0.5 | 0.10 | 0.08 | 0.47 | 0 | 0 | bal. | 0.11 | 0.06 | 0.10 | 28.23 | A + A-4 | 4% |
| 104 | 22.7 | 7.4 | 0 | 0.909 | 0.5 | 0.05 | 0.08 | 0.47 | 0 | 0 | bal. | 0.11 | 0.06 | 0.10 | 28.23 | A + A-5 | 4% |
| 105 | 22.7 | 7.4 | 0 | 0.909 | 0.5 | 0.10 | 0.08 | 0.43 | 0 | 0 | bal. | 0.11 | 0.06 | 0.10 | 28.23 | A + A-6 | 4% |
| 106 | 22.7 | 7.4 | 0 | 0.909 | 2.0 | 0.10 | 0.08 | 0.47 | 0 | 0 | bal. | 0.11 | 0.06 | 0.10 | 28.23 | A + A-7 | 4% |
| 107 | 22.7 | 7.4 | 0 | 0.909 | 0.5 | 0.05 | 0.08 | 0.42 | 0.1 | 0 | bal. | 0.11 | 0.06 | 0.10 | 28.23 | A + A-8 | 4% |
| 108 | 22.7 | 7.4 | 0 | 0.909 | 0.5 | 0.05 | 0.08 | 0.41 | 0 | 0.1 | bal. | 0.11 | 0.06 | 0.10 | 28.23 | A + A-9 | 4% |
| 109 | 22.7 | 7.4 | 0 | 0.909 | 0.5 | 0.05 | 0.08 | 0.40 | 0.03 | 0.05 | bal. | 0.11 | 0.06 | 0.10 | 28.23 | A + A-10 | 4% |
| 110 | 22.7 | 7.4 | 0 | 0.917 | 0.5 | 0.10 | 0.13 | 0.27 | 0 | 0 | bal. | 0.14 | 0.04 | 0.08 | 28.45 | A + A-11 | 4% |
| 111 | 22.7 | 7.4 | 0 | 0.879 | 0.9 | 0.10 | 0.15 | 0.39 | 0 | 0 | bal. | 0.12 | 0.06 | 0.09 | 28.25 | A + A-12 | 4% |
| 112 | 22.7 | 7.4 | 0 | 0.891 | 0.9 | 0.10 | 0.15 | 0.39 | 0 | 0 | bal. | 0.13 | 0.06 | 0.09 | 28.19 | A + A-13 | 4% |
| 113 | 22.7 | 7.4 | 0 | 0.909 | 0.9 | 0.10 | 0.15 | 0.31 | 0 | 0 | bal. | 0.16 | 0.06 | 0.11 | 27.78 | A + A-14 | 4% |
| 114 | 22.7 | 7.4 | 0 | 0.923 | 0.9 | 0.10 | 0.15 | 0.28 | 0 | 0 | bal. | 0.16 | 0.06 | 0.11 | 27.85 | A + A-15 | 4% |
| 115 | 22.7 | 7.4 | 0 | 0.889 | 0.5 | 0.10 | 0.15 | 0.35 | 0 | 0 | bal. | 0.11 | 0.04 | 0.07 | 28.53 | A + A-16 | 4% |
| 116 | 20.7 | 6.7 | 3.0 | 0.904 | 0.5 | 0.10 | 0.08 | 0.34 | 0 | 0 | bal. | 0.11 | 0.06 | 0.10 | 28.46 | A + A-17 | 4% |
| 117 | 22.1 | 7.2 | 0 | 0.849 | 0.5 | 0.10 | 0.13 | 0.54 | 0 | 0 | bal. | 0.08 | 0.02 | 0.06 | 28.26 | A + A-18 | 4% |
| 118 | 21.6 | 7.2 | 0 | 0.890 | 0.5 | 0.10 | 0.11 | 0.46 | 0 | 0 | bal. | 0.09 | 0.02 | 0.06 | 27.69 | A + A-19 | 4% |
| 119 | 21.6 | 7.1 | 0 | 0.909 | 0.5 | 0.10 | 0.11 | 0.43 | 0 | 0 | bal. | 0.09 | 0.01 | 0.07 | 27.53 | A + A-20 | 4% |
| 120 | 22.4 | 7.3 | 0 | 0.899 | 0.5 | 0.10 | 0.11 | 0.38 | 0 | 0.09 | bal. | 0.10 | 0.06 | 0.07 | 27.93 | A + A-21 | 4% |
| 121 | 23.6 | 7.8 | 0 | 0.891 | 0.5 | 0.10 | 0.16 | 0.50 | 0 | 0 | bal. | 0.08 | 0.03 | 0.07 | 30.15 | B + B-1 | 1% |
| 122 | 22.7 | 7.4 | 0 | 0.910 | 0.5 | 0.05 | 0.08 | 0.40 | 0.03 | 0.05 | bal. | 0.11 | 0.05 | 0.10 | 26.33 | B + B-2 | 1% |
| 123 | 22.7 | 7.4 | 0 | 0.91 | 60.5 | 0.10 | 0.13 | 0.27 | 0 | 0 | bal. | 0.14 | 0.03 | 0.08 | 28.55 | B + B-3 | 1% |
| 124 | 22.7 | 7.4 | 0 | 0.880 | 0.9 | 0.10 | 0.15 | 0.39 | 0 | 0 | bal. | 0.12 | 0.05 | 0.09 | 28.35 | B + B-4 | 1% |
| 125 | 22.7 | 7.4 | 0 | 0.910 | 0.9 | 0.10 | 0.15 | 0.31 | 0 | 0 | bal. | 0.16 | 0.05 | 0.11 | 27.88 | B + B-5 | 1% |
| 126 | 22.7 | 7.4 | 0 | 0.890 | 0.5 | 0.10 | 0.15 | 0.35 | 0 | 0 | bal. | 0.11 | 0.03 | 0.07 | 28.63 | B + B-6 | 1% |
| 127 | 20.7 | 6.7 | 3.0 | 0.905 | 0.5 | 0.10 | 0.08 | 0.34 | 0 | 0 | bal. | 0.11 | 0.05 | 0.10 | 28.56 | B + B-7 | 1% |
| 128 | 23.6 | 7.8 | 0 | 0.888 | 0.5 | 0.10 | 0.16 | 0.50 | 0 | 0 | bal. | 0.08 | 0.03 | 0.08 | 30.07 | C + C-1 | 10% |
| 129 | 22.7 | 7.4 | 0 | 0.911 | 0.5 | 0.05 | 0.08 | 0.40 | 0.03 | 0.05 | bal. | 0.11 | 0.05 | 0.11 | 28.25 | C + C-2 | 10% |
| 130 | 22.7 | 7.4 | 0 | 0.918 | 0.5 | 0.10 | 0.13 | 0.27 | 0 | 0 | bal. | 0.14 | 0.03 | 0.09 | 28.47 | C + C-3 | 10% |
| 131 | 22.7 | 7.4 | 0 | 0.881 | 0.9 | 0.10 | 0.15 | 0.39 | 0 | 0 | bal. | 0.12 | 0.05 | 0.10 | 28.27 | C + C-4 | 10% |
| 132 | 22.7 | 7.4 | 0 | 0.909 | 0.9 | 0.10 | 0.15 | 0.31 | 0 | 0 | bal. | 0.16 | 0.05 | 0.12 | 27.80 | C + C-5 | 10% |
| 133 | 22.7 | 7.4 | 0 | 0.891 | 0.5 | 0.10 | 0.15 | 0.35 | 0 | 0 | bal. | 0.11 | 0.03 | 0.08 | 28.55 | C + C-6 | 10% |
| 134 | 20.7 | 6.7 | 3.0 | 0.903 | 0.5 | 0.10 | 0.08 | 0.34 | 0 | 0 | bal. | 0.11 | 0.05 | 0.11 | 28.48 | C + C-7 | 10% |
| 135 | 22.7 | 7.4 | 0 | 0.911 | 0.5 | 0.05 | 0.08 | 0.40 | 0.03 | 0.05 | bal. | 0.11 | 0.04 | 0.11 | 28.30 | D + D-1 | 10% |
| 136 | 22.7 | 7.4 | 0 | 0.908 | 0.5 | 0.05 | 0.08 | 0.40 | 0.03 | 0.05 | bal. | 0.10 | 0.05 | 0.11 | 28.31 | E + E-1 | 30% |
| 137 | 22.7 | 7.4 | 0 | 0.917 | 0.5 | 0.10 | 0.13 | 0.27 | 0 | 0 | bal. | 0.13 | 0.03 | 0.09 | 28.53 | E + E-2 | 30% |
| 138 | 22.7 | 7.4 | 0 | 0.879 | 0.9 | 0.10 | 0.15 | 0.39 | 0 | 0 | bal. | 0.11 | 0.05 | 0.10 | 28.33 | E + E-3 | 30% |

TABLE 8-continued

| | Analysis results of R-T-B-based sintered magnet (% by mass) | | | | | | | | | | | | | | | Mixed alloy | Mixing amount of additional alloy |
|---|---|---|---|---|---|---|---|---|---|---|---|---|---|---|---|---|---|
| No. | Nd | Pr | Dy | B | Co | Al | Cu | Ga | Nb | Zr | Fe | O | N | C | v | powder | powder |
| 139 | 22.7 | 7.4 | 0 | 0.911 | 0.9 | 0.10 | 0.15 | 0.31 | 0 | 0 | bal. | 0.15 | 0.05 | 0.12 | 27.86 | E + E-4 | 30% |
| 140 | 22.7 | 7.4 | 0 | 0.889 | 0.5 | 0.10 | 0.15 | 0.35 | 0 | 0 | bal. | 0.10 | 0.03 | 0.08 | 28.61 | E + E-5 | 30% |

TABLE 9

| No. | $B_r$ (T) | $H_{cJ}$ (kA/m) |
|---|---|---|
| 100 | 1.407 | 1508 |
| 101 | 1.368 | 1628 |
| 102 | 1.388 | 1653 |
| 103 | 1.414 | 1582 |
| 104 | 1.429 | 1534 |
| 105 | 1.418 | 1578 |
| 106 | 1.419 | 1580 |
| 107 | 1.425 | 1564 |
| 108 | 1.426 | 1553 |
| 109 | 1.427 | 1560 |
| 110 | 1.408 | 1573 |
| 111 | 1.391 | 1662 |
| 112 | 1.395 | 1607 |
| 113 | 1.439 | 1518 |
| 114 | 1.448 | 1502 |
| 115 | 1.396 | 1553 |
| 116 | 1.351 | 2061 |
| 117 | 1.405 | 1490 |
| 118 | 1.433 | 1480 |
| 119 | 1.419 | 1605 |
| 120 | 1.429 | 1520 |
| 121 | 1.384 | 1633 |
| 122 | 1.423 | 1540 |
| 123 | 1.404 | 1553 |
| 124 | 1.387 | 1642 |
| 125 | 1.435 | 1498 |
| 126 | 1.392 | 1533 |
| 127 | 1.347 | 2041 |
| 128 | 1.380 | 1613 |
| 129 | 1.419 | 1520 |
| 130 | 1.400 | 1533 |
| 131 | 1.383 | 1622 |
| 132 | 1.431 | 1478 |
| 133 | 1.388 | 1513 |
| 134 | 1.343 | 2021 |
| 135 | 1.419 | 1520 |
| 136 | 1.415 | 1500 |
| 137 | 1.396 | 1513 |
| 138 | 1.379 | 1602 |
| 139 | 1.427 | 1458 |
| 140 | 1.384 | 1493 |

As shown in Table 9, any of samples Nos. 100 to 140 of an R-T-B based sintered magnet produced by mixing the additional alloy powder with the main alloy powder has high magnetic properties of $B_r \geq 1.343$ T and $H_{cJ} \geq 1{,}458$ kA/m.

Example 5

Using Nd metal, Pr metal, Dy metal, ferroboron alloy, electrolytic Co, Al metal, Cu metal, Ga metal and electrolytic iron (any of metals has a purity of 99% by mass or more), each additional alloy powder and each main alloy powder were mixed so as to obtain a composition shown in Table 10, and then these raw materials were melted and subjected to casting by a strip casting method to obtain a flaky alloy having a thickness of 0.2 to 0.4 mm. The flaky alloy thus obtained was subjected to hydrogen grinding in a hydrogen atmosphere under an increased pressure and then subjected to a dehydrogenation treatment of heating to 550° C. in vacuum and cooling to obtain a coarsely pulverized powder. The coarsely pulverized powder thus obtained of the additional alloy and the coarsely pulverized powder thus obtained of the main alloy were loaded in a given mixing amount in a V-type mixer, followed by mixing to obtain a mixed alloy powder. To the mixed alloy powder thus obtained, zinc stearate was added as a lubricant in the proportion of 0.04% by mass based on 100% by mass of the coarsely pulverized powder, followed by mixing. Using an air flow-type pulverizer (jet milling machine), the mixture was subjected to dry pulverization in a nitrogen gas flow to obtain a mixed alloy poweder which is a finely pulverized powder having a grain size $D_{50}$ of 4 μm. By mixing the nitrogen gas with atmospheric air during pulverization, the oxygen concentration in a nitrogen gas during pulverization was adjusted. When mixing with no atmospheric air, the oxygen concentration in the nitrogen gas during pulverization is 50 ppm or less and the oxygen concentration in the nitrogen gas was increased to 1,600 ppm at a maximum by mixing with atmospheric air to produce finely pulverized powders each having a different oxygen amount. The grain size $D_{50}$ is a median size on a volume basis obtained by a laser diffraction method using an air flow dispersion method. O (amount of oxygen), N (amount of nitrogen), and C (amount of carbon) in Table 11, were measured in the same manner as in Example 1.

To a finely pulverized powder (mixed alloy powder) obtained by mixing an additional alloy powder with a main alloy powder, zinc stearate was added as a lubricant in the proportion of 0.05% by mass based on 100% by mass of the coarsely pulverized powder, followed by mixing to obtain a compact in the same manner as in Example 1. Furthermore, the compact was sintered and subjected to a heat treatment in the same manner as in Example 1. The sintered magnet was subjected to machining after the heat treatment, and then $B_r$ and $H_{cJ}$ of each sample were measured in the same manner as in Example 1. The measurement results are shown in Table 12.

Each composition of the thus obtained additional alloy powder and main alloy powder to be used in the production method of the present invention is shown in Table 10. Furthermore, each composition of the R-T-B based sintered magnet obtained by mixing the additional alloy powder and the main alloy powder in Table 10 is shown in Table 11. Sample No. 150 in Table 11 is an R-T-B based sintered magnet produced using a mixed alloy powder obtained by mixing an F alloy powder (additional alloy powder), an F-1 alloy powder (main alloy powder) and an F-2 alloy powder (main alloy powder) in Table 10, and a mixing amount of the additional alloy powder (F) accounts for 4%, a mixing amount of the main alloy powder (F-1) accounts for 48%, and a mixing amount of the main alloy powder (F-2) accounts for 48%, of 100% by mass of the mixed alloy powder. Furthermore, sample No. 151 is an R-T-B based sintered magnet produced using a mixed alloy powder obtained by mixing an F alloy powder (additional alloy powder), an F-3 alloy powder (main alloy powder) and an F-4 alloy powder (main alloy powder) in Table 10, and a mixing amount of the additional alloy powder (F) accounts for 4%, a mixing amount of the main alloy powder (F-3) accounts for 48%, and a mixing amount of the main alloy powder (F-4) accounts for 48%, of 100% by mass of the mixed alloy powder. Samples Nos. 152 to 158 were produced by combination of a mixed alloy powder and a mixing amount of an additional alloy powder shown in Table 11 in the same manner. Any of the composition of the additional alloy powder and the main alloy powder shown in Table 10, and the mixing amount of the additional alloy powder shown in Table 11 is within the range of preferred aspects (aspects 3 and 4) of the present invention. Furthermore, any of the composition of the R-T-B based sintered magnet shown in Table 11 is within the range of the composition of the R-T-B based sintered magnet of the present invention.

TABLE 10

| Alloy | | Analysis results of alloy powder (% by mass) | | | | | | | | | | |
|---|---|---|---|---|---|---|---|---|---|---|---|---|
| powder | Type of alloy | Nd | Pr | Dy | B | Co | Al | Cu | Ga | Nb | Zr | Fe |
| F | Additional alloy powder | 42.5 | 13.9 | 0 | 0.500 | 0.0 | 0.10 | 0.15 | 6.79 | 0 | 0 | bal. |
| F-1 | Main alloy powder | 21.9 | 7.2 | 0 | 0.960 | 0.9 | 0.10 | 0.15 | 0.01 | 0 | 0 | bal. |
| F-2 | Main alloy powder | 21.9 | 7.2 | 0 | 0.922 | 0.9 | 0.10 | 0.15 | 0.01 | 0 | 0 | bal. |
| F-3 | Main alloy powder | 21.9 | 7.2 | 0 | 0.981 | 0.9 | 0.10 | 0.15 | 0.01 | 0 | 0 | bal. |
| F-4 | Main alloy powder | 21.9 | 7.2 | 0 | 0.900 | 0.9 | 0.10 | 0.15 | 0.01 | 0 | 0 | bal. |
| F-5 | Main alloy powder | 21.9 | 7.2 | 0 | 1.002 | 0.9 | 0.10 | 0.15 | 0.01 | 0 | 0 | bal. |
| F-6 | Main alloy powder | 21.9 | 7.2 | 0 | 0.881 | 0.9 | 0.10 | 0.15 | 0.01 | 0 | 0 | bal. |
| F-7 | Main alloy powder | 21.9 | 7.2 | 0 | 0.960 | 0.9 | 0.10 | 0.15 | 0.01 | 0 | 0 | bal. |
| F-8 | Main alloy powder | 21.9 | 7.2 | 0 | 0.900 | 0.9 | 0.10 | 0.15 | 0.01 | 0 | 0 | bal. |
| F-9 | Main alloy powder | 21.9 | 7.1 | 0 | 0.951 | 0.9 | 0.10 | 0.15 | 0.04 | 0 | 0 | bal. |
| F-10 | Main alloy powder | 21.9 | 7.1 | 0 | 0.901 | 0.9 | 0.10 | 0.15 | 0.04 | 0 | 0 | bal. |
| F-11 | Main alloy powder | 21.9 | 7.1 | 0 | 0.958 | 0.9 | 0.10 | 0.15 | 0.04 | 0 | 0 | bal. |
| F-12 | Main alloy powder | 21.9 | 7.1 | 0 | 0.891 | 0.9 | 0.10 | 0.15 | 0.04 | 0 | 0 | bal. |
| F-13 | Main alloy powder | 21.9 | 7.1 | 0 | 0.968 | 0.9 | 0.10 | 0.15 | 0.04 | 0 | 0 | bal. |
| F-14 | Main alloy powder | 21.9 | 7.1 | 0 | 0.882 | 0.9 | 0.10 | 0.15 | 0.04 | 0 | 0 | bal. |
| F-15 | Main alloy powder | 21.9 | 7.2 | 0 | 0.951 | 0.5 | 0.05 | 0.08 | 0.21 | 0 | 0 | bal. |
| F-16 | Main alloy powder | 21.9 | 7.2 | 0 | 0.901 | 0.5 | 0.05 | 0.08 | 0.21 | 0 | 0 | bal. |
| F-17 | Main alloy powder | 21.9 | 7.2 | 0 | 0.959 | 0.5 | 0.05 | 0.08 | 0.21 | 0 | 0 | bal. |
| F-18 | Main alloy powder | 21.9 | 7.2 | 0 | 0.892 | 0.5 | 0.05 | 0.08 | 0.21 | 0 | 0 | bal. |

TABLE 11

| | Analysis results of R-T-B-based sintered magnet (% by mass) | | | | | | | | | | | | | | Combination of mixed alloy | Mixing amount of additional |
|---|---|---|---|---|---|---|---|---|---|---|---|---|---|---|---|---|
| No. | Nd | Pr | Dy | B | Co | Al | Cu | Ga | Nb | Zr | Fe | O | N | C | v | powder | alloy powder |
| 150 | 22.7 | 7.4 | 0 | 0.924 | 0.9 | 0.10 | 0.15 | 0.28 | 0 | 0 | bal. | 0.16 | 0.06 | 0.10 | 27.89 | F + F-1 + F-2 | F: 4%<br>F-1: 48%<br>F-2: 48% |
| 151 | 22.7 | 7.4 | 0 | 0.922 | 0.9 | 0.10 | 0.15 | 0.28 | 0 | 0 | bal. | 0.15 | 0.05 | 0.11 | 27.91 | F + F-3 + F-4 | F: 4%<br>F-3: 48%<br>F-4: 48% |
| 152 | 22.7 | 7.4 | 0 | 0.920 | 0.9 | 0.10 | 0.15 | 0.28 | 0 | 0 | bal. | 0.15 | 0.04 | 0.10 | 28.09 | F + F-5 + F-6 | F: 4%<br>F-5: 48%<br>F-6: 48% |
| 153 | 22.7 | 7.4 | 0 | 0.921 | 0.9 | 0.10 | 0.15 | 0.28 | 0 | 0 | bal. | 0.15 | 0.05 | 0.10 | 27.92 | F + F-7 + F-8 | F: 4%<br>F-7: 48%<br>F-8: 48% |
| 154 | 22.7 | 7.4 | 0 | 0.910 | 0.9 | 0.10 | 0.15 | 0.31 | 0 | 0 | bal. | 0.15 | 0.05 | 0.11 | 27.80 | F + F-9 + F-10 | F: 4%<br>F-9: 48%<br>F-10: 48% |
| 155 | 22.7 | 7.4 | 0 | 0.909 | 0.9 | 0.10 | 0.15 | 0.31 | 0 | 0 | bal. | 0.16 | 0.06 | 0.10 | 27.78 | F + F-11 + F-12 | F: 4%<br>F-11: 48%<br>F-12: 48% |
| 156 | 22.7 | 7.4 | 0 | 0.909 | 0.9 | 0.10 | 0.15 | 0.31 | 0 | 0 | bal. | 0.16 | 0.06 | 0.11 | 27.74 | F + F-13 + F-14 | F: 4%<br>F-13: 48%<br>F-14: 48% |
| 157 | 22.7 | 7.4 | 0 | 0.910 | 0.5 | 0.05 | 0.08 | 0.47 | 0 | 0 | bal. | 0.10 | 0.05 | 0.09 | 28.27 | F + F-15 + F-16 | F: 4%<br>F-15: 48%<br>F-16: 48% |
| 158 | 22.7 | 7.4 | 0 | 0.909 | 0.5 | 0.05 | 0.08 | 0.47 | 0 | 0 | bal. | 0.11 | 0.05 | 0.10 | 28.19 | F + F-17 + F-18 | F: 4%<br>F-17: 48%<br>F-18: 48% |

TABLE 12

| No. | $B_r$ (T) | $H_{cJ}$ [kA/m] |
|---|---|---|
| 150 | 1.445 | 1501 |
| 151 | 1.444 | 1498 |
| 152 | 1.441 | 1495 |
| 153 | 1.447 | 1504 |
| 154 | 1.440 | 1517 |
| 155 | 1.439 | 1519 |
| 156 | 1.438 | 1523 |
| 157 | 1.430 | 1530 |
| 158 | 1.429 | 1529 |

As shown in Table 12, any of samples Nos. 150 to 158 of an R-T-B based sintered magnet produced by mixing one kind of an additional alloy powder with two kinds of main alloy powders has high magnetic properties of $B_r \geq 1.429$ T and $H_{cJ} \geq 1{,}495$ kA/m.

INDUSTRIAL APPLICABILITY

The R-T-B-based sintered magnet according to the present invention can be suitably employed in motors for hybrid cars and electric cars.

The invention claimed is:

1. An R-T-B based sintered magnet represented by the following formula (1):

$$uRwBxGayCuzAlqM(100\text{-}u\text{-}w\text{-}x\text{-}y\text{-}z\text{-}q)T \quad (1)$$

where

R is composed of light rare-earth element(s) RL and optionally heavy rare-earth element(s) RH, RL is Nd and/or Pr, RH is at least one of Dy, Tb, Gd and Ho, T is Fe, and 10% by mass or less of Fe being replaced with Co, M is Nb and/or Zr, and u, w, x, y, z, q and 100-u-w-x-y-z-q are expressed in terms of % by mass;

said RH accounts for 5% by mass or less of the R-T-B based sintered magnet, the following inequality expressions (2) to (5) being satisfied:

$$0.20 \leq x \leq 0.70 \quad (2)$$

$$0.07 \leq y \leq 0.2 \quad (3)$$

$$0.05 \leq z \leq 0.5 \quad (4)$$

$$0 \leq q \leq 0.1 \quad (5)$$

$v = u - (6\alpha + 10\beta + 8\gamma)$, where the amount of oxygen (% by mass) of the R-T-B based sintered magnet is $\alpha$, the amount of nitrogen (% by mass) is $\beta$, and the amount of carbon (% by mass) is $\gamma$;

$0.84 \leq w \leq 0.93$;

when $0.40 \leq x \leq 0.70$, v and w satisfy the following inequality expressions (6) and (7):

$$50w - 18.5 \leq v \leq 50w - 14 \quad (6)$$

$$-12.5w + 38.75 \leq v \leq -62.5w + 86.125 \quad (7)$$

and, when $0.20 \leq x < 0.40$, v and w satisfy the following inequality expressions (8) and (9), and x satisfies the following inequality expression (10):

$$50w - 18.5 \leq v \leq 50w - 15.5 \quad (8)$$

$$-12.5w + 39.125 \leq v \leq -62.5w + 86.125 \quad (9)$$

$$-(62.5w + v - 81.625)/15 + 0.5 \leq x \leq -(62.5w + v - 81.625)/15 + 0.8 \quad (10);$$

wherein $H_{cJ}$ of the R-T-B based sintered magnet satisfies the following expression:

$H_{cJ}$ (kA/m) $\geq 1{,}300 + 160[Dy] + 240[Tb]$, where the amount of Dy (% by mass) is [Dy] and the amount of Tb (% by mass) is [Tb].

2. The R-T-B based sintered magnet according to claim 1, wherein, when $0.40 \leq x \leq 0.70$, v and w satisfy the following inequality expressions (11) and (7):

$$50w - 18.5 \leq v \leq 50w - 16.25 \quad (11)$$

$$-12.5w + 38.75 \leq v \leq -62.5w + 86.125 \quad (7)$$

and, when $0.20 \leq x < 0.40$, v and w satisfy the following inequality expressions (12) and (9), and x satisfies the following inequality expression (10):

$$50w - 18.5 \leq v \leq 50w - 17.0 \quad (12)$$

$$-12.5w + 39.125 \leq v \leq -62.5w + 86.125 \quad (9)$$

$$-(62.5w + v - 81.625)/15 + 0.5 \leq x \leq -(62.5w + v - 81.625)/15 + 0.8 \quad (10).$$

3. The R-T-B based sintered magnet according to claim 1, wherein the amount of oxygen is 0.15% by mass or less.

4. A method for producing an R-T-B based sintered magnet represented by the following formula (1):

$$uRwBxGayCuzAlqM(100\text{-}u\text{-}w\text{-}x\text{-}y\text{-}z\text{-}q)T \quad (1)$$

where

R is composed of light rare-earth element(s) RL and heavy rare-earth element(s) RH, RL is Nd and/or Pr, RH is at least one of Dy, Tb, Gd and Ho, T is Fe, and 10% by mass or less of Fe is capable of being replaced with Co, M is Nb and/or Zr, and u, w, x, y, z, q, and 100-u-w-x-y-z-q are expressed in terms of % by mass;

said RH accounts for 5% by mass or less of the R-T-B based sintered magnet, the following inequality expressions (2) to (5) being satisfied:

$$0.20 \leq x \leq 0.70 \quad (2)$$

$$0.07 \leq y \leq 0.2 \quad (3)$$

$$0.05 \leq z \leq 0.5 \quad (4)$$

$$0 \leq q \leq 0.1 \quad (5)$$

$v = u - (6\alpha + 10\beta + 8\gamma)$, where the amount of oxygen (% by mass) of the R-T-B based sintered magnet is $\alpha$, the amount of nitrogen (% by mass) is $\beta$, and the amount of carbon (% by mass) is $\gamma$; and when $0.40 \leq x \leq 0.70$, v and w satisfy the following inequality expressions (6) and (7):

$$50w - 18.5 \leq v \leq 50w - 14 \quad (6)$$

$$-12.5w + 38.75 \leq v \leq -62.5w + 86.125 \quad (7)$$

and, when $0.20 \leq x \leq 0.40$, v and w satisfy the following inequality expressions (8) and (9), and x satisfies the following inequality expression (10):

$$50w - 18.5 \leq v \leq 50w - 15.5 \quad (8)$$

$$-12.5w + 39.125 \leq v \leq -62.5w + 86.125 \quad (9)$$

$$-(62.5w + v - 81.625)/15 + 0.5 \leq x \leq -(62.5w + v - 81.625)/15 + 0.8 (10)$$

the method comprising:

a step of preparing one or more kinds of additional alloy powders and one or more kinds of main alloy powders;

a step of mixing the one or more additional alloy powders with 0.5% by mass or more and 40% by mass or less among 100% by mass of the mixed alloy powder after mixing to obtain a mixed alloy powder of one or more kinds of additional alloy powders and one or more kinds of main alloy powders;

a compacting step of compacting the mixed alloy powder to obtain a compact;

a sintering step of sintering the compact to obtain a sintered body; and a heat treatment step of subjecting the sintered body to a heat treatment;

wherein one or more kinds of additional alloy powders are respectively represented by the following inequality expression (13), each having the composition satisfying the following inequality expressions (14) to (20):

$$aRbBcGadCueAlfM(100\text{-}a\text{-}b\text{-}c\text{-}d\text{-}e\text{-}f)T \quad (13)$$

where

R is composed of light rare-earth element(s) RL and heavy rare-earth element(s) RH, RL is Nd and/or Pr, RH is at least one of Dy, Tb, Gd and Ho, T as balance is Fe, and 10% by mass or less of Fe is capable of being replaced with Co, M is Nb and/or Zr, and a, b, c, d, e, f and 100-a-b-c-d-e-f are expressed in terms of % by mass:

$$32\% \le a \le 66\% \quad (14)$$

$$0.2\% \le b \quad (15)$$

$$0.7\% \le c \le 12\% \quad (16)$$

$$0\% \le d \le 4\% \quad (17)$$

$$0\% \le e \le 10\% \quad (18)$$

$$0\% \le f \le 2\% \quad (19)$$

$$100-a-b-c-d-e-f \le 72.4b \quad (20)$$

and the Ga content of one or more main alloy powders is 0.4% by mass or less.

5. The method for producing an R-T-B based sintered magnet according to claim 4, wherein, when $0.40 \le x \le 0.70$, v and w satisfy the following inequality expressions (11) and (7):

$$50w-18.5 \le v \le 50w-16.25 \quad (11)$$

$$-12.5w+38.75 \le v \le -62.5w+86.125 \quad (7)$$

and, when $0.20 \le x \le 0.40$, v and w satisfy the following inequality expressions (12) and (9), and x satisfies the following inequality expression (10):

$$50w-18.5 \le v \le 50w-17.0 \quad (12)$$

$$-12.5w+39.125 \le v \le -62.5w+86.125 \quad (9)$$

$$-(62.5w+v-81.625)/15+0.5 \le x \le -(62.5w+v-81.625)/15+0.8 \quad (10).$$

6. The method for producing an R-T-B based sintered magnet according to claim 4, wherein the amount of oxygen of the R-T-B based sintered magnet is 0.15% by mass or less.

7. The R-T-B based sintered magnet according to claim 1, wherein $B_r$ of the R-T-B based sintered magnet satisfies the following expression:

$$B_r(T) \ge 1.340-0.024[Dy]-0.024[Tb].$$

8. An R-T-B based sintered magnet represented by the following formula (1):

$$uRwBxGayCuzAlqM(100\text{-}u\text{-}w\text{-}x\text{-}y\text{-}z\text{-}q)T \quad (1)$$

where

R is composed of light rare-earth element(s) RL and optionally heavy rare-earth element(s) RH, RL is Nd and/or Pr, RH is at least one of Dy, Tb, Gd and Ho, T is Fe, and 10% by mass or less of Fe being replaced with Co, M is Nb and/or Zr, and u, w, x, y, z, q and 100-u-w-x-y-z-q are expressed in terms of % by mass;

said RH accounts for 5% by mass or less of the R-T-B based sintered magnet, the following inequality expressions (2) to (5) being satisfied:

$$0.20 \le x \le 0.70 \quad (2)$$

$$0.07 \le y \le 0.2 \quad (3)$$

$$0.05 \le z \le 0.5 \quad (4)$$

$$0 \le q \le 0.1 \quad (5)$$

$v=u-(6\alpha+10\beta+8\gamma)$, where the amount of oxygen (% by mass) of the R-T-B based sintered magnet is $\alpha$, the amount of nitrogen (% by mass) is $\beta$, and the amount of carbon (% by mass) is $\gamma$;

$0.84 \le w \le 0.910$;

when $0.40 \le x \le 0.70$, v and w satisfy the following inequality expressions (6) and (7):

$$50w-18.5 \le v \le 50w-14 \quad (6)$$

$$-12.5w+38.75 \le v \le -62.5w+86.125 \quad (7)$$

and, when $0.20 \le x \le 0.40$, v and w satisfy the following inequality expressions (8) and (9), and x satisfies the following inequality expression (10):

$$50w-18.5 \le v \le 50w-15.5 \quad (8)$$

$$-12.5w+39.125 \le v \le -62.5w+86.125 \quad (9)$$

$$-(62.5w+v-81.625)/15+0.5 \le x \le -(62.5w+v-81.625)/15+0.8 \quad (10).$$

9. The R-T-B based sintered magnet according to claim 8, wherein $H_{cJ}$ and $B_r$ of the R-T-B based sintered magnet satisfy the following expressions:

$$H_{cJ}(kA/m) \ge 1{,}300+160[Dy]+240[Tb], \text{ and}$$

$$B_r(T) \ge 1.340-0.024[Dy]-0.024[Tb],$$

where the amount of Dy (% by mass) is [Dy] and the amount of Tb (% by mass) is [Tb].

* * * * *